US010451064B2

(12) United States Patent
Park et al.

(10) Patent No.: US 10,451,064 B2
(45) Date of Patent: Oct. 22, 2019

(54) COMPRESSOR

(71) Applicant: Samsung Electronics Co., Ltd., Suwon-si (KR)

(72) Inventors: Jung-Hoon Park, Suwon-si (KR); Nam Kyu Cho, Seoul (KR); Yang Sun Kim, Anyang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 235 days.

(21) Appl. No.: 15/233,253

(22) Filed: Aug. 10, 2016

(65) Prior Publication Data

US 2017/0045049 A1 Feb. 16, 2017

(30) Foreign Application Priority Data

Aug. 11, 2015 (KR) ..... 10-2015-0113023

(51) Int. Cl.

*F04C 18/02* (2006.01)
*F04C 28/16* (2006.01)
*F04C 23/00* (2006.01)

(52) U.S. Cl.

CPC ..... *F04C 18/0215* (2013.01); *F04C 18/0253* (2013.01); *F04C 23/008* (2013.01); *F04C 28/16* (2013.01)

(58) Field of Classification Search

CPC ..... F01C 20/26; F01C 19/08; F01C 1/0215; F04C 18/0215; F04C 18/0253; F04C 28/16

(Continued)

(56) References Cited

U.S. PATENT DOCUMENTS 5,613,841 A * 3/1997 Bass ..... F01C 21/102 417/310
6,293,767 B1 * 9/2001 Bass ..... F04C 23/008 417/213

(Continued)

FOREIGN PATENT DOCUMENTS

CN 102588275 7/2012
CN 104061157 9/2014

(Continued)

OTHER PUBLICATIONS

International Search Report dated Oct. 12, 2016 in International Patent Application No. PCT/KR2016/008640.

(Continued)

*Primary Examiner* — Deming Wan
(74) *Attorney, Agent, or Firm* — Staas & Halsey LLP

(57) ABSTRACT

A compressor includes a discharge guide provided to communicate a discharge port and a bypass port to a discharge cover so that refrigerant discharged from the discharge port and the bypass port is guided to the discharge cover and a middle-pressure chamber formed by the fixed scroll, the back-pressure cover, and the discharge guide. The compressor according to the embodiments guarantees the space in which the bypass valve can be installed by a discharge guide mounted to a discharge portion of the fixed scroll, and at the same time forms the middle pressure portion, resulting in efficiency improvement of the compressor. The compressor according to the embodiments reduces noise and vibration generated from the discharge portion of the fixed scroll by the discharge guide.

20 Claims, 32 Drawing Sheets

(58) Field of Classification Search
USPC ..... 418/55.1–55.6
See application file for complete search history.

(56) References Cited

U.S. PATENT DOCUMENTS

| | | | | |
|---|---|---|---|---|
| 8,517,703 | B2 * | 8/2013 | Doepker | F04C 18/0215 137/511 |
| 8,579,604 | B2 * | 11/2013 | Liang | F04C 18/0215 417/292 |
| 9,249,802 | B2 | 2/2016 | Doepker et al. | |
| 9,297,383 | B2 | 3/2016 | Jin et al. | |
| 2008/0219872 | A1 | 9/2008 | Reinhart et al. | |
| 2011/0206548 | A1 | 8/2011 | Doepker | |
| 2014/0064999 | A1 | 3/2014 | Magaduni et al. | |
| 2014/0271302 | A1 | 9/2014 | Kim et al. | |

FOREIGN PATENT DOCUMENTS

| | | |
|---|---|---|
| CN | 104061158 | 9/2014 |
| EP | 0747598 | 12/1996 |
| JP | 2014-231833 | 12/2014 |
| KR | 10-2014-0114212 | 9/2014 |

OTHER PUBLICATIONS

Chinese Office Action dated Sep. 29, 2018 in Chinese Patent Application No. 201680047067.8.
Extended European Search Report dated Aug. 2, 2018 in European Patent Application No. 16835384.5.

* cited by examiner

100

100

200

200a

200d

200e

COMPRESSOR

CROSS-REFERENCE TO RELATED APPLICATIONS

This application claims the priority benefit of Korean Patent Application No. 10-2015-0113023, filed on Aug. 11, 2015 in the Korean Intellectual Property Office, the disclosure of which is incorporated herein by reference.

BACKGROUND

1. Field

The following description relates to a compressor, and more particularly to a bypass structure of a compression chamber of a scroll compressor.

2. Description of the Related Art

Generally, a scroll compressor is an apparatus for compressing refrigerant using relative movement between a fixed scroll and an orbiting scroll, each of which has a spiral wrap. When compared with a reciprocating compressor or a rotary compressor, the scroll compressor has higher efficiency, lower vibration and noise, a smaller size, and a lighter weight. Accordingly, the scroll compressor has been widely used in refrigeration cycle devices such as air conditioning systems.

The scroll compressor includes a compression portion formed by the fixed scroll and the orbiting scroll. The fixed scroll is seated in and fixed to a housing such as an airtight container. The orbiting scroll revolves (or orbits) with respect to the fixed scroll. The compression portion becomes smaller in width in the direction from an outer circumference to an inner circumference thereof due to revolutions of the orbiting scroll. The refrigerant is suctioned from the outer circumference of the compression portion and then compressed in the compression portion, and is finally discharged from the center part of the compression portion to the inside of the housing.

Because the fixed scroll and the orbiting scroll perform orbiting motion while being in contact with each other, a middle pressure portion is formed in the fixed scroll, and the middle pressure portion presses the fixed scroll toward the orbiting scroll, such that the desired sealing property remains unchanged.

However, because the middle pressure portion is provided in the fixed scroll, it is impossible to form a sufficient-sized space in which a bypass valve can be formed, in the region of the fixed scroll, such that the conventional scroll compressor has difficulty in optimizing the efficiency of compression at a low load state.

SUMMARY

Therefore, it is an aspect of the present disclosure to provide a compressor structure including a middle pressure portion formed in a manner that a compressor includes an effective bypass structure.

It is an aspect of the present disclosure to provide a compressor structure including a bypass valve that is difficult to be mounted to a fixed back-pressure scroll compressor, such that high-pressure refrigerant over-compressed in a low load state is discharged through the bypass valve, resulting in improvement of low-load efficiency.

It is an aspect of the present disclosure to provide a compressor structure for effectively reducing noise and vibration when refrigerant is discharged.

Additional aspects of the present disclosure will be set forth in part in the description which follows and, in part, will be obvious from the description, or may be learned by practice of the present disclosure.

In accordance with one aspect of the present disclosure, a compressor includes a main body, a discharge cover fixed to an indoor space of the main body to divide the indoor space of the main body into a suction space and a discharge space, a compression chamber formed by a fixed scroll and an orbiting scroll to compress refrigerant, a discharge port formed in the fixed scroll to discharge compressed refrigerant to the outside of the compression chamber, a bypass port formed in the fixed scroll to discharge refrigerant being compressed to the outside of the compression chamber, a discharge guide configured independently from the fixed scroll, provided to communicate the discharge port and the bypass port to the discharge cover so that refrigerant discharged from the discharge port and the bypass port is guided to the discharge cover, a back-pressure cover provided over the discharge guide, provided to separate a high-pressure part and a low-pressure part contained in the main body from each other and a middle-pressure chamber formed by the fixed scroll, the back-pressure cover, and the discharge guide.

The discharge guide includes a first cover portion configured to cover an uppermost surface of the fixed scroll, a second cover portion configured to cover the bypass port and the discharge port, and formed to protrude upward from the first cover portion, a guide portion opened upward from the second cover portion.

The compressor further includes a discharge valve configured to open or close the discharge port and a bypass valve configured to open or close the bypass port.

The second cover portion covers the discharge valve and the bypass valve.

The second cover portion includes a rounding portion.

The compressor further includes a middle-pressure chamber discharge port through which refrigerant is discharged from the compression chamber and flows into the middle-pressure chamber.

The discharge guide includes a pass-through portion by which refrigerant discharged from the middle-pressure chamber discharge port passes through the discharge guide and flows into the middle-pressure chamber.

The pass-through portion is configured in a shape formed by severing of one side of the first cover portion.

The back-pressure cover is configured to perform reciprocating motion in a vertical direction by pressure of refrigerant flowing into the middle-pressure chamber.

The back-pressure cover includes an opening portion disposed between the guide portion and the discharge cover and a first ring-shaped wall provided to communicate the discharge guide to the discharge cover during an ascending motion of the back-pressure cover.

The back-pressure cover includes an inner circumference formed to extend from an upper part of the discharge guide to one side of the fixed scroll to cover the discharge guide and the uppermost surface of the fixed scroll.

The inner circumference of the back-pressure cover includes a ring-shaped wall formed to extend from a lower part of the uppermost surface of the fixed scroll to one side of the fixed scroll.

The fixed scroll includes a back-pressure cover guide which corresponds to the second ring-shaped wall and guides vertical reciprocating motion of the back-pressure cover.

The fixed scroll includes a ring-shaped middle-pressure wall formed to extend upward along an outer wall of the uppermost surface of the fixed scroll.

The discharge guide is provided in an indoor space formed by the middle-pressure wall.

The back-pressure cover includes an outer circumference contacting an inner circumference of the middle-pressure wall and the outer circumference of the back-pressure cover is guided to the inner circumference of the middle-pressure wall and performs vertical motion.

The middle-pressure chamber is formed by the inner circumference of the middle-pressure wall, an inner surface of the back-pressure cover, and the outer surface of the discharge guide.

The middle-pressure chamber is formed by the inner circumference of the middle-pressure wall, an inner surface of the back-pressure cover, the outer surface of the discharge guide, and one side of the uppermost surface of the fixed scroll.

In accordance with an aspect of the present disclosure, a compressor includes a main body, a fixed scroll fixed to an indoor space of the main body, and configured to include a flat uppermost surface, an orbiting scroll configured to perform orbiting motion with respect to the fixed scroll, a compression chamber, which is formed by the fixed scroll and the orbiting scroll to compress refrigerant and includes a discharge passage through which compressed refrigerant is discharged and a bypass passage through which refrigerant being compressed is discharged, discharge valve and a bypass valve which are located at an uppermost surface of the fixed scroll, wherein the discharge valve is configured to open or close the discharge passage and the bypass valve is configured to open or close the bypass passage, a discharge guide configured independently from the fixed scroll, provided to cover the discharge valve, the bypass valve, and an uppermost surface of the fixed scroll, a back-pressure cover provided above the discharge guide and a middle-pressure chamber formed by the fixed scroll, the back-pressure cover, and the discharge guide.

Some parts of the discharge guide are opened in a manner that refrigerant passes through the discharge guide in the compression chamber and flows into the middle-pressure chamber.

The discharge passage is configured to communicate with an upper part of the fixed scroll at a center part of the compression chamber in a manner that compressed refrigerant is discharged to the outside of the compression chamber; and one end of the bypass passage communicates with an upper part of the compression chamber, and the other end of the bypass passage is bended at one end of the bypass passage and thus communicates with one side of the discharge passage.

The bypass valve is provided on the bypass passage and is located at a bended part of the bypass passage to open or close the bypass passage.

The bypass valve is located at an inner surface of the discharge passage to open or close the other end of the bypass passage.

The discharge guide includes a first cover portion to cover an uppermost surface of the fixed scroll, a second cover portion to cover the discharge valve, and formed to protrude upward from the first cover portion and a guide portion formed to include an opening that is opened upward from the second cover portion.

One end of the bypass passage is located at a position corresponding to the second cover portion and the other end of the bypass passage is located at a position corresponding to the guide portion.

BRIEF DESCRIPTION OF THE DRAWINGS

These and/or other aspects of the present disclosure will become apparent and more readily appreciated from the following description of the embodiments, taken in conjunction with the accompanying drawings of which.

DETAILED DESCRIPTION

Figure 1:
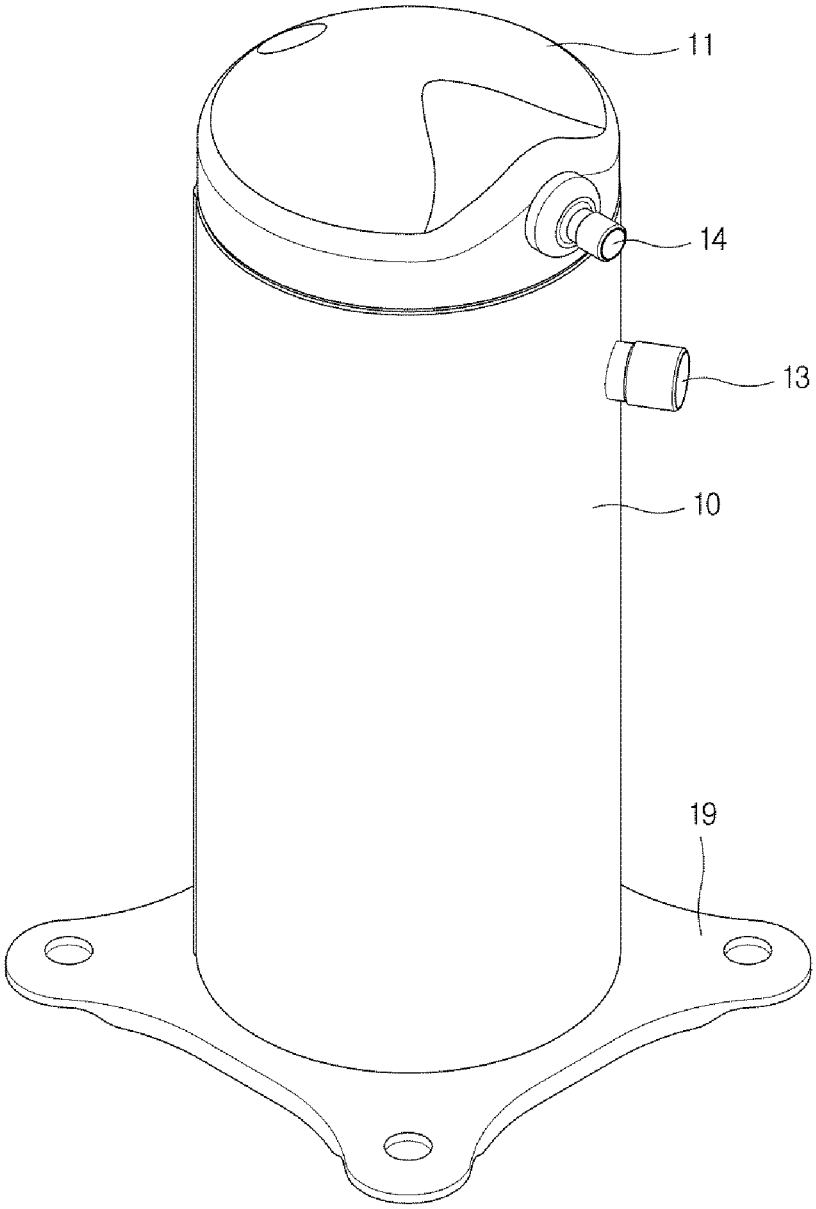
FIG. 1 is a perspective view illustrating a compressor according to an embodiment of the present disclosure.

Reference will now be made in detail to the embodiments of the present disclosure, examples of which are illustrated in the accompanying drawings, wherein like reference numerals refer to like elements throughout.

The terms used in the present application are merely used to describe specific embodiments and are not intended to limit the present invention. A singular expression may include a plural expression unless otherwise stated in the context. In the present application, the terms "including" or "having" are used to indicate that features, numbers, steps, operations, components, parts or combinations thereof described in the present specification are present and presence or addition of one or more other features, numbers, steps, operations, components, parts or combinations is not excluded.

In description of the present invention, the terms "first" and "second" may be used to describe various components, but the components are not limited by the terms. The terms may be used to distinguish one component from another component. For example, a first component may be called a second component and a second component may be called a first component without departing from the scope of the present invention. The term "and/or" may include a combination of a plurality of items or any one of a plurality of items.

The compressor according to embodiments will hereinafter be described with reference to the attached drawings.

Figure 2:
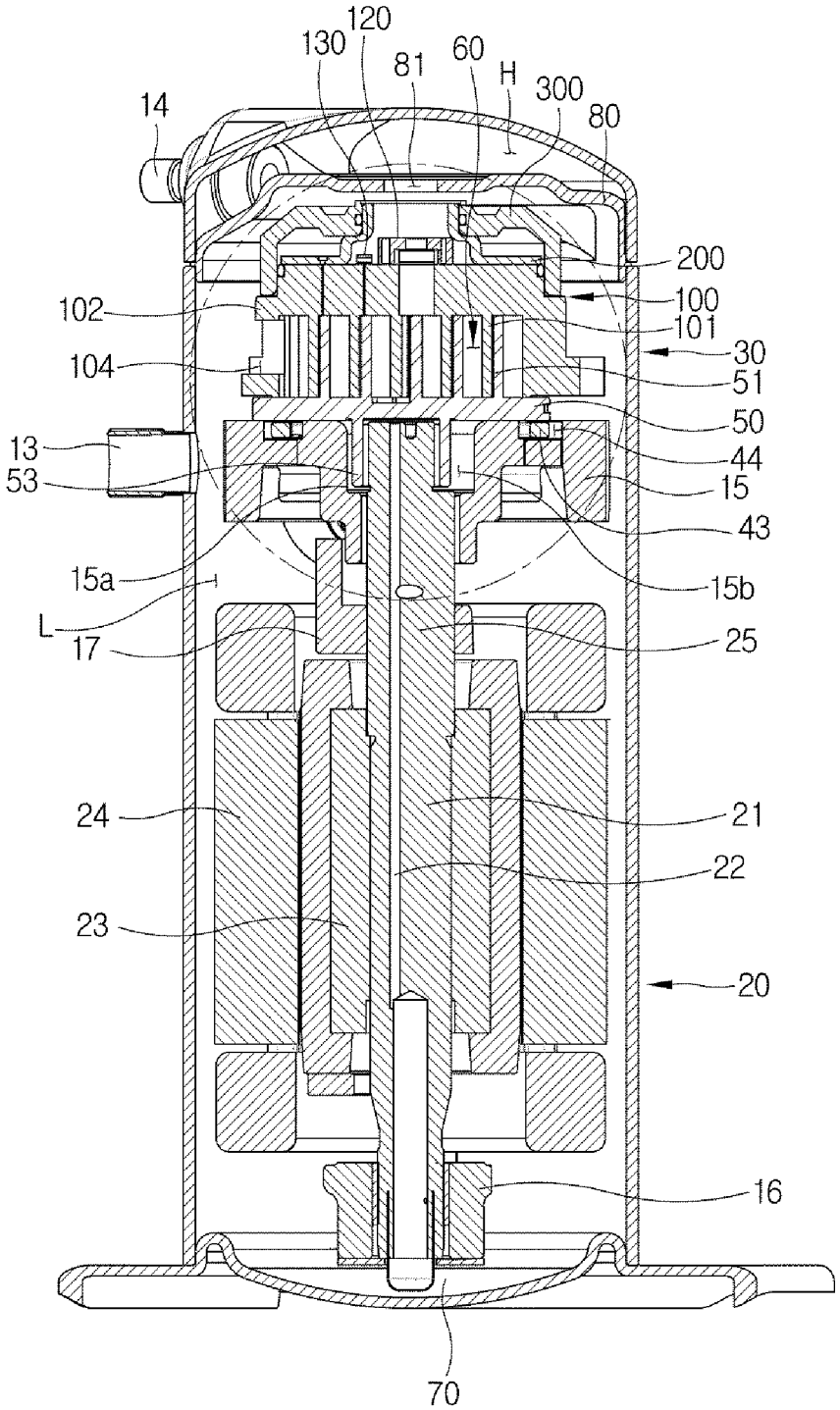
FIG. 2 is an enlarged side cross-sectional view illustrating a compressor according to an embodiment of the present disclosure.
Figure 3:
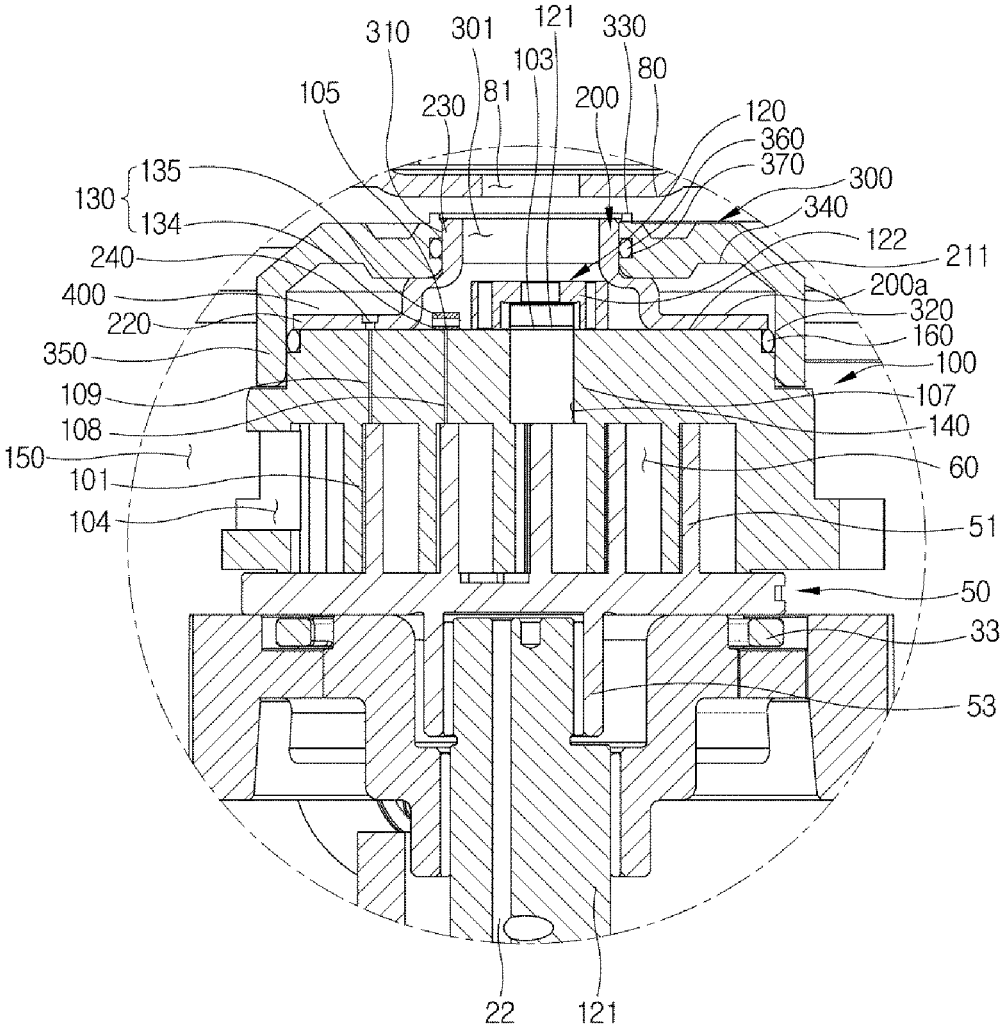
FIG. 3 is an enlarged side cross-sectional view illustrating some constituent elements of the compressor according to an embodiment of the present disclosure.
Figure 4:
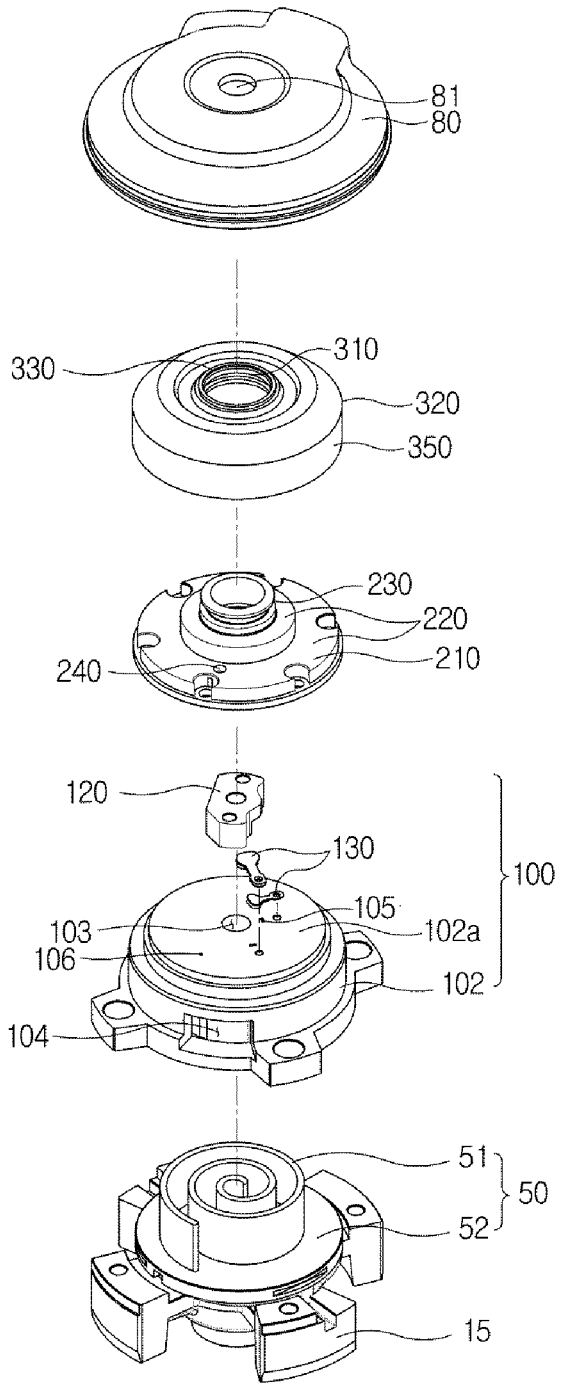
FIG. 4 is an exploded perspective view illustrating some constituent elements of the compressor according to an embodiment of the present disclosure.
Figure 5:
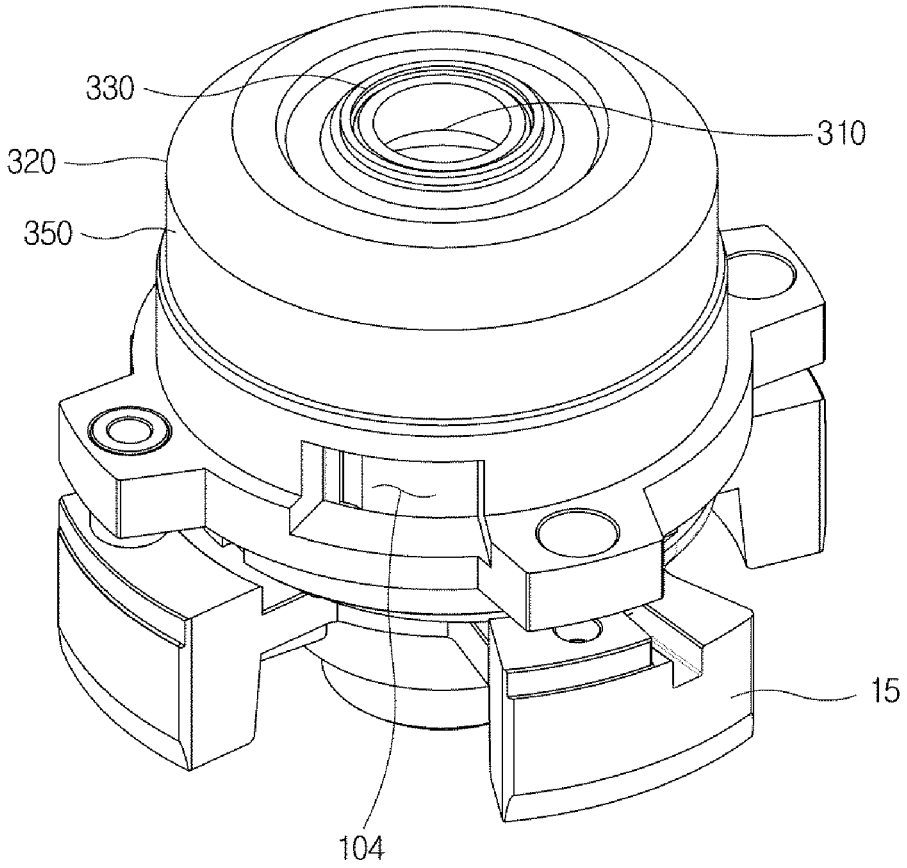
FIG. 5 is a perspective view illustrating some constituent elements of the compressor according to an embodiment of the present disclosure.
Figure 6:
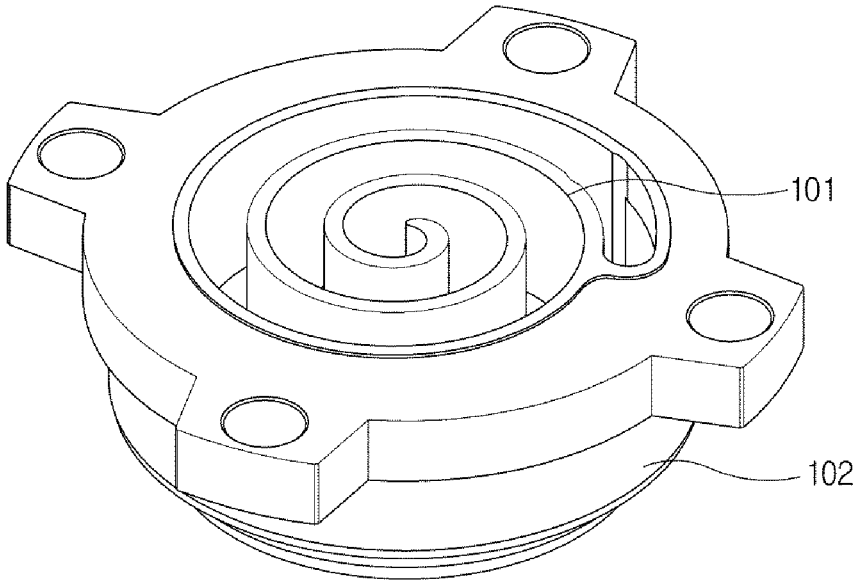
FIG. 6 is a perspective view illustrating a fixed scroll of the compressor according to an embodiment of the present disclosure.
Figure 7:
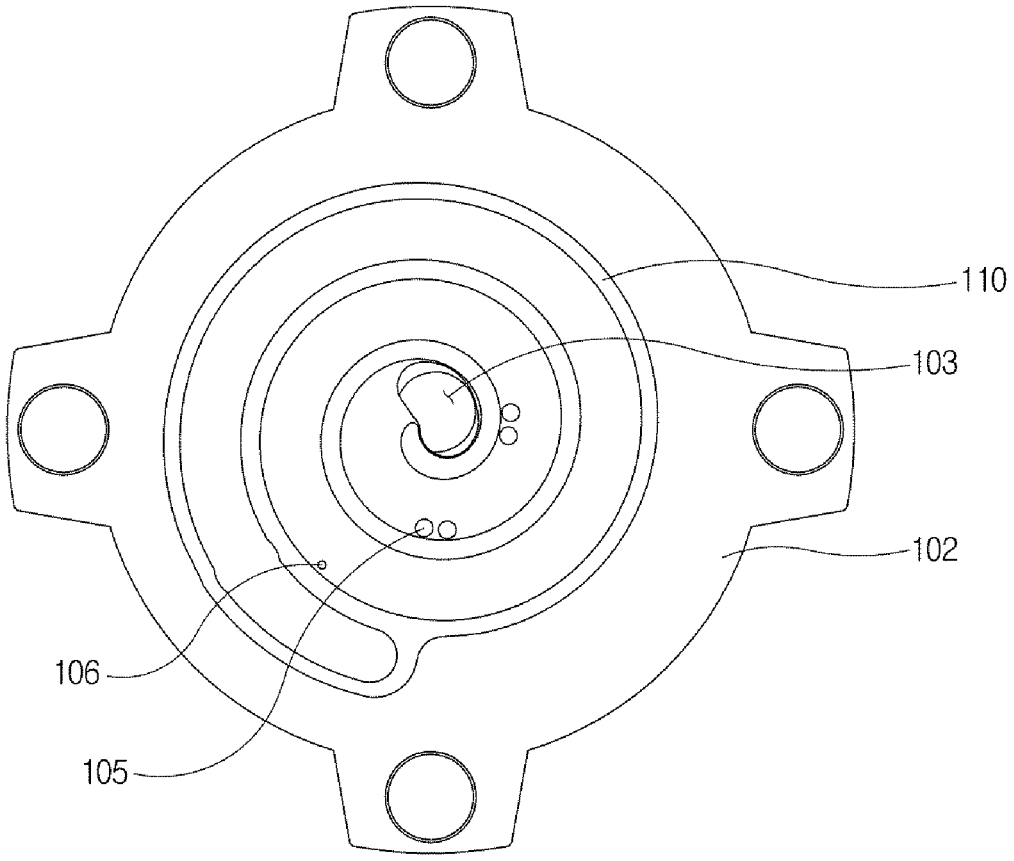
FIG. 7 is a rear view illustrating a fixed scroll of the compressor according to an embodiment of the present disclosure.
Figure 8:
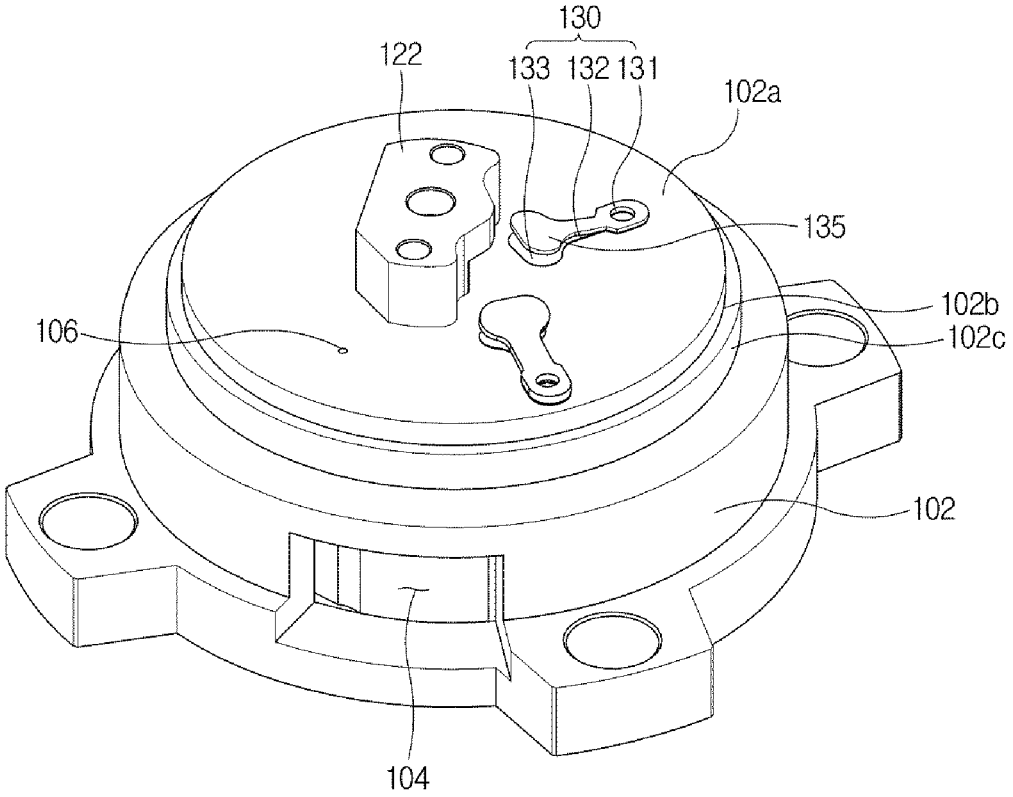
FIG. 8 is a perspective view illustrating some constituent elements of the compressor according to an embodiment of the present disclosure.
Figure 9:
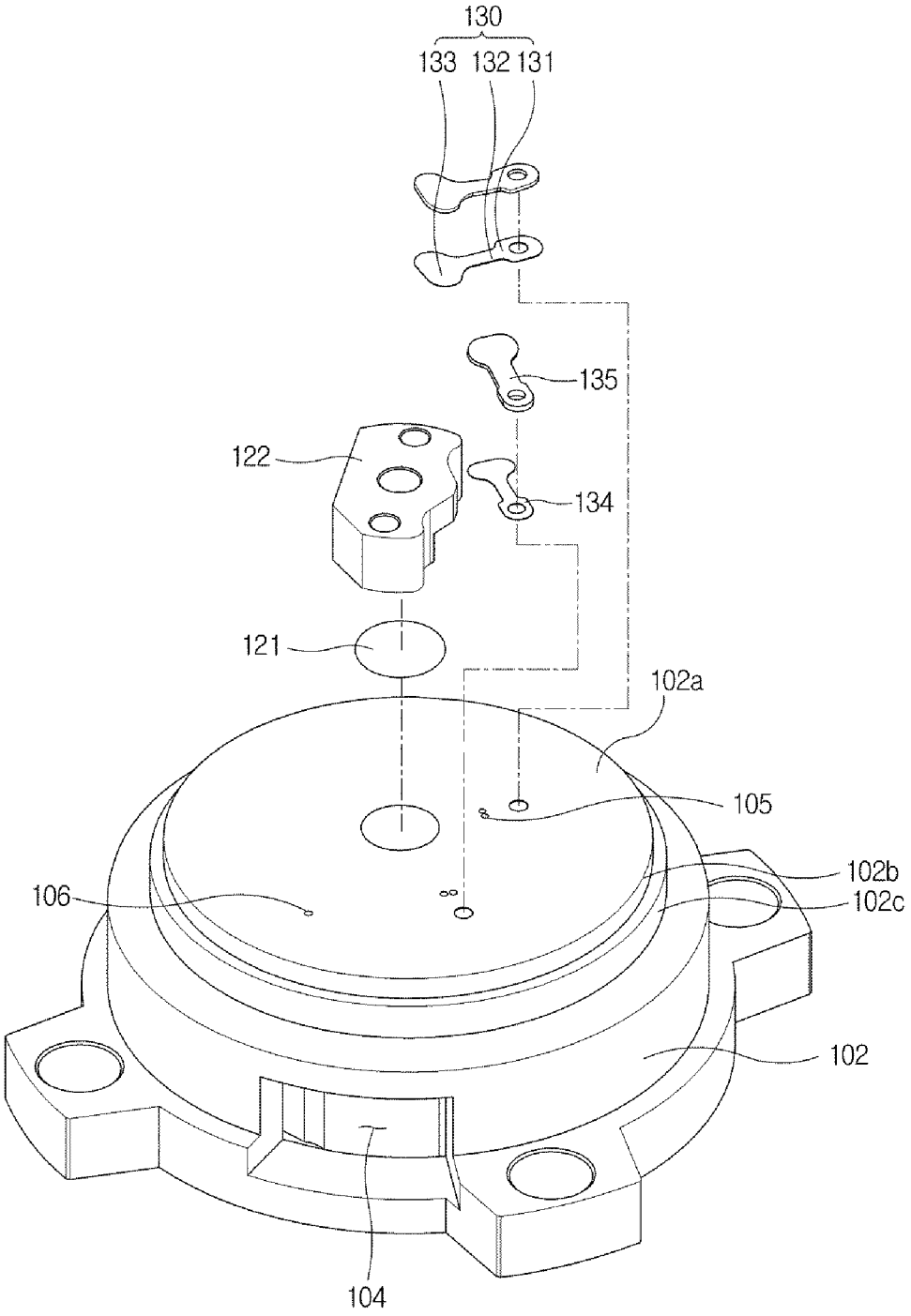
FIG. 9 is an exploded perspective view illustrating some constituent elements of the compressor according to an embodiment of the present disclosure.
Figure 10:
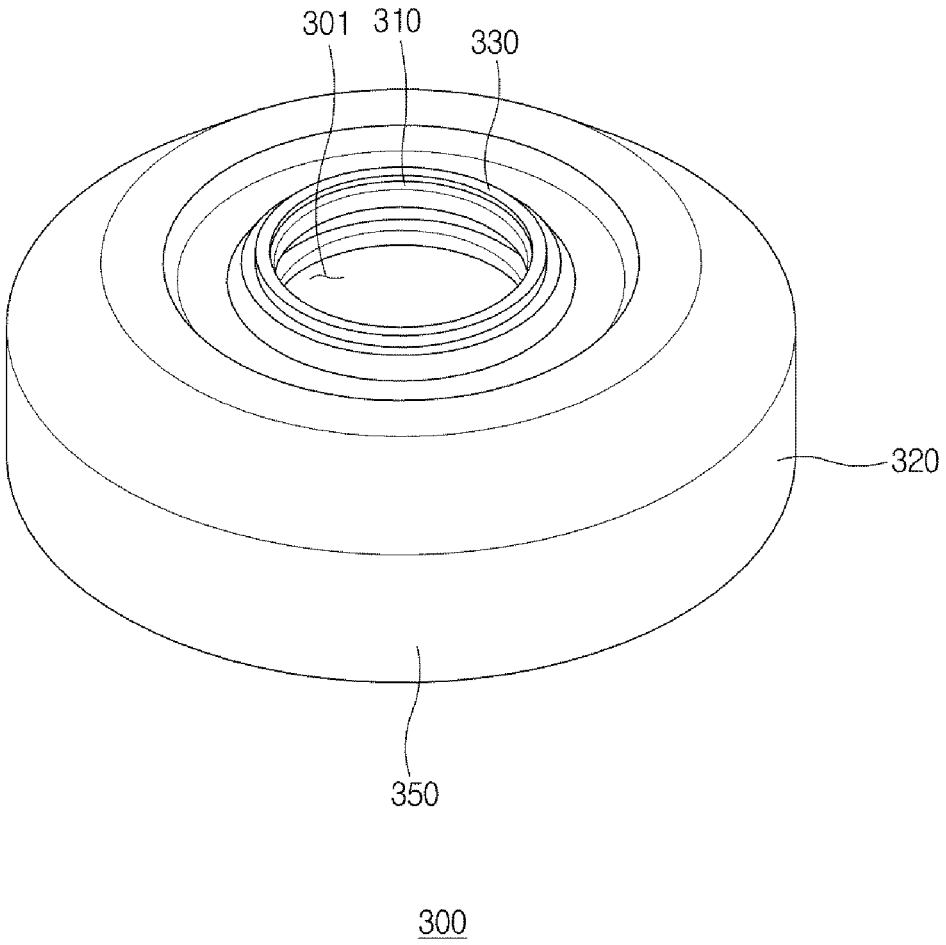
FIG. 10 is a perspective view illustrating a back-pressure cover of the compressor according to an embodiment of the present disclosure.
Figure 11:
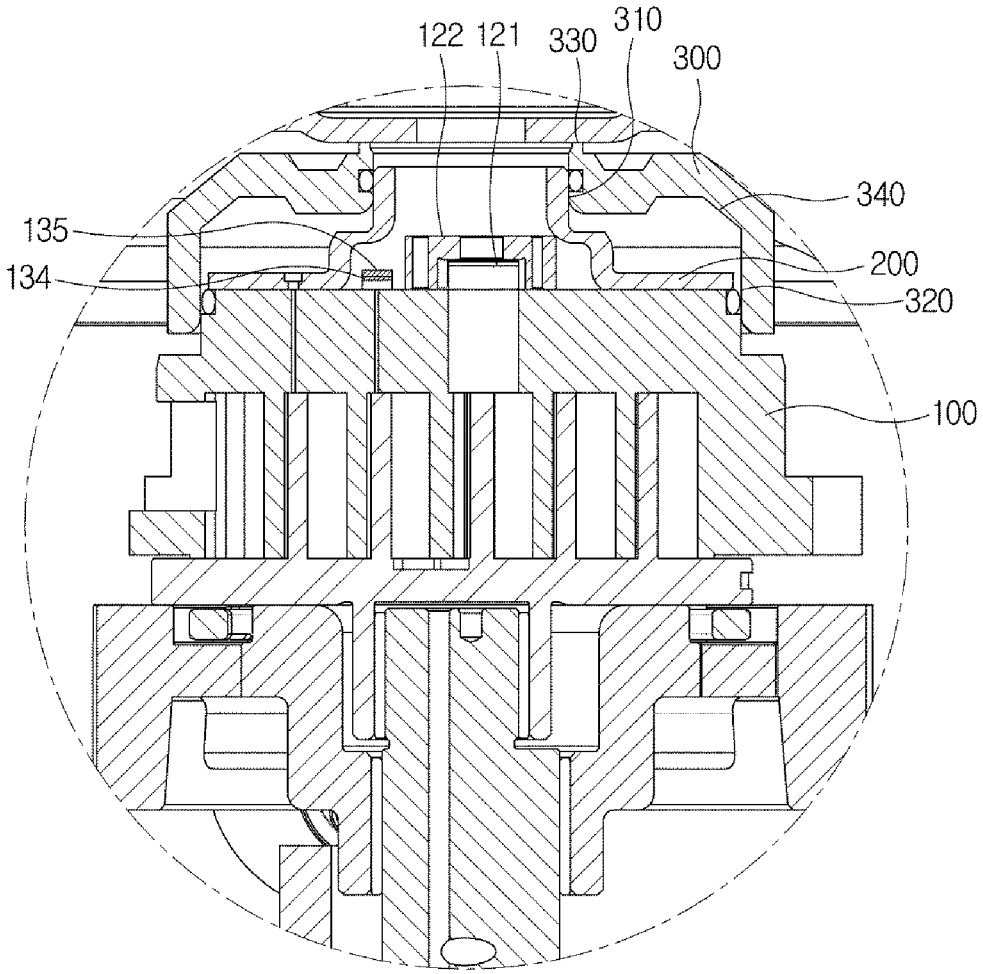
FIG. 11 is an enlarged side cross-sectional view illustrating some constituent elements of the compressor when the compressor is driven according to an embodiment of the present disclosure.

FIG. 1 is a perspective view illustrating a compressor according to an embodiment of the present disclosure. FIG. 2 is a side cross-sectional view illustrating a compressor according to an embodiment of the present disclosure. FIG. 3 is an enlarged side cross-sectional view illustrating some constituent elements of the compressor according to an embodiment of the present disclosure. FIG. 4 is an exploded perspective view illustrating some constituent elements of the compressor according to an embodiment of the present disclosure. FIG. 5 is a perspective view illustrating some constituent elements of the compressor according to an embodiment of the present disclosure. FIG. 6 is a perspective view illustrating a fixed scroll of the compressor according to an embodiment of the present disclosure. FIG. 7 is a rear view illustrating a fixed scroll of the compressor according to an embodiment of the present disclosure. FIG. 8 is a perspective view illustrating some constituent elements of the compressor according to an embodiment of the present disclosure. FIG. 9 is an exploded perspective view illustrating some constituent elements of the compressor according to an embodiment of the present disclosure. FIG. 10 is a perspective view illustrating a back-pressure cover of the compressor according to an embodiment of the present disclosure. FIG. 11 is an enlarged side cross-sectional view illustrating some constituent elements of the compressor when the compressor is driven according to an embodiment of the present disclosure.

Referring to FIGS. 1 to 5, the compressor may include a main body 10 having a closed inner space, and a drive unit 20 and a compression portion 30 located in the main body 10. A bottom plate 19 stably seated on and fixed to the bottom surface may be provided at an outer surface of the compressor 1.

A suction inlet 13 through which a refrigerant is introduced may be disposed at one side of the main body 10, and a discharge outlet 14 through which the compressed refrigerant received through the inlet 13 is discharged to the outside, may be disposed at the other side of the main body 10. An upper cap 11 for sealing an indoor space of the main body 10 may be disposed at an upper part of the main body 10.

The drive unit 20 may include a stator 24 press-fitted into a lower part of the main body 10, and a rotor 23 rotatably installed at the center of the stator 24. A balance weight 17 may be mounted to each of the upper and lower parts of the rotor 23 such that it adjusts unbalanced rotation of the rotor 23 during rotation of the rotor 23.

An upper flange 15 and a lower flange 16 may be respectively fixed to an inner upper part and an inner lower part of the main body 10. The drive unit 20 may be disposed between the upper flange 15 and the lower flange 16. A rotation shaft 21 may be disposed between the upper flange 15 and the lower flange 16, such that rotational force generated from the drive unit 20 may be applied to the orbiting scroll of the compression portion 30. An eccentric portion 25 eccentrically spaced from the center point of the rotation shaft 21 may be disposed at an upper end of the rotation shaft 21.

A through-hole 15*a* through which the rotation shaft 21 passes may be disposed at the center of the upper flange 15. An oil storage (reservoir) portion 15*b* configured to accommodate oil suctioned through the rotation shaft 21 may be formed in the vicinity of the through-hole 15*a*. An oil flow pipe 22 may be formed in the rotation shaft 21 in a longitudinal direction of the rotation shaft 21, and an oil pump (not shown) may be mounted to a lower end of the oil flow pipe 22.

An oil storage space 70 may be located at the inner bottom surface of the main body 10. A lower end of the rotation shaft may extend to the region of oil stored in the oil storage space 70 such that oil stored in the oil storage space 70 moves upward through the oil flow pipe 22 formed in a longitudinal direction of the rotation shaft 21.

Oil stored in the oil storage space 70 may be pumped by an oil pump (not shown) mounted to a lower end of the rotation shaft 21, such that the oil may move to the upper end of the rotation shaft 21 along the oil flow pipe 22 formed in the rotation shaft 21 and may thus arrive at the compression portion 30.

The compression portion 30 may include a fixed scroll 100 to compress a refrigerant introduced into the main body 10, and an orbiting scroll 50 to perform relative orbiting motion with respect to the fixed scroll 100. The fixed scroll 100 may be fixedly coupled to the main body 10 in a manner that the fixed scroll 100 is located at an upper part of the upper flange 15, and the orbiting scroll 50 may be disposed between the fixed scroll 100 and the upper flange 15 in a manner that the orbiting scroll orbits with respect to the fixed scroll 100. The rotation shaft 21 is inserted into the orbiting scroll 50 such that the orbiting scroll 50 is driven by the rotation shaft 21, and a spiral-shaped orbiting wrap 51 is formed at the top surface of the orbiting scroll 50. A fixed wrap 101 is formed at the bottom surface of the fixed scroll 100 in a manner that the fixed scroll 100 is meshed with the orbiting wrap 51 of the orbiting scroll 50.

The orbiting wrap 51 of the orbiting scroll 50 is meshed with the fixed wrap 101 of the fixed scroll 100, resulting in formation of a compression chamber 60. An Oldham's ring accommodation portion 44 may be disposed between the orbiting scroll 50 and the upper flange 15. An Oldham's ring 43 may be contained in the Oldham's ring accommodation portion to orbit the orbiting scroll while simultaneously preventing rotation of the orbiting scroll 50.

The orbiting scroll 50 may include an orbiting plate 52 formed to have a predetermined thickness and area, an orbiting wrap 51 formed to have a predetermined thickness and height at the top surface of the orbiting plate 52, and a boss portion 53 formed at the bottom surface of the orbiting plate 52.

An oil flow passage (not shown) formed to communicate with the oil flow pipe 22 at the inside of the boss portion 53 may be provided in the orbiting plate 52 supporting the orbiting wrap 51. Oil may be introduced into the compression portion 30 through the oil flow passage (not shown) such that the oil may perform lubrication actions in a manner that the compression portion 30 can smoothly compress the refrigerant.

If a power-supply signal is applied to the compressor 1, the rotation shaft 21 rotates with the rotor 23, and the orbiting scroll 50 coupled to the upper end of the rotation shaft 21 may rotate. The orbiting scroll 50 may orbit an eccentric distance from the center of the rotation shaft 21 to the center of an eccentric portion 24 as an orbiting radius. In this case, rotation of the orbiting scroll 50 is prevented by the Oldham's ring 43.

The orbiting scroll 50 orbits with respect to the fixed scroll 100, such that the compression chamber 60 may be formed between the orbiting wrap 51 and the fixed wrap 101. The compression chamber 60 moves to the center part by successive orbiting motion of the orbiting scroll 50, such that volume of the compression chamber 60 is reduced and the suctioned refrigerant can be compressed.

The refrigerant compressed by the compression chamber 60 may be discharged upward of the fixed scroll 100 such that the resultant refrigerant may move to the discharge cover 80 located upward of the compression portion 30. The discharge cover 80 may cover the entirety of an inner circumference of the main body, and may include an opening 81 through which the discharged refrigerant may pass.

The inner space of the main body 10 may be divided into a high-pressure portion H and a low-pressure portion L by the discharge cover 80. The upper part of the discharge cover 80 may correspond to the high-pressure portion H, and the lower part thereof may correspond to the low-pressure portion L.

Low-pressure refrigerant introduced into the main body 10 through the inlet 13 may be primarily introduced into the low-pressure portion L. High-pressure refrigerant having passed through the compression chamber 60 may pass through the opening 81 of the discharge cover 80, and may then flow to the high-pressure portion H.

Refrigerant flowing in the low-pressure portion L may move along the outer surface of the compression portion 30 and the drive unit 20, such that the refrigerant may cool the compression portion 30 and the drive unit 20. High-pressure refrigerant having passed through the compression chamber 60 may move to the high-pressure portion H disposed between the upper cap 11 and the discharge cover 80, and may then be discharged to the outside of the main body 10 through the outlet 14.

Referring to FIGS. 6 to 9, the fixed scroll 100 may include a body 102 configured in a specific shape, a fixed wrap 101 formed to have a predetermined thickness and height at the inside of the body 102, a discharge port 103 formed to pass through the center of the body 102, and an inlet 104 formed at one side of the body 102.

The refrigerant introduced into the main body 10 through the inlet 13 may be introduced into the fixed scroll 100 through the inlet 104. Because the refrigerant introduced into the compression chamber 60 moves to the center part of the compression chamber 60 during the orbiting motion of the orbiting scroll 50, the refrigerant is compressed in the compression chamber 60, such that the resultant refrigerant may be discharged to the outside of the fixed scroll through the discharge port 103.

The discharge port 103 may be provided at an uppermost surface 102*a* of the fixed scroll 100. Preferably, the discharge port 103 may be located at the center of the uppermost surface 102*a*.

A discharge passage 107 through which the compression chamber 60 communicates with the discharge port 103 at the center part of the compression chamber 60. In more detail, the discharge passage 107 may be implemented as a tube-shaped passage ranging from the compression chamber 60 to the upper part of the fixed scroll 100, such that the tube-shaped discharge passage 107 may be located at the center of the fixed scroll 100.

One end of the discharge passage 107 may communicate with the center part of the compression chamber 60, and the discharge port 103 may be located at the other end of the discharge passage 107. Therefore, refrigerant introduced into the compression chamber 60 flows to the center of the compression chamber 60 through orbiting motion such that the refrigerant is compressed. The compressed refrigerant may move to the discharge port 103 through the discharge passage 107, and may then be discharged to the fixed scroll 100.

The refrigerant discharged from the discharge port 103 may pass through the discharge guide 200 and the back-pressure cover 300, may be introduced into the high-pressure portion L through the discharge cover 80, and may be discharged to the outside of the compressor 1 through the outlet 14.

Not only the tube-shaped bypass passage 108 formed to pass through an upper side of the fixed scroll 100, but also the bypass port 105 provided on the uppermost surface 102*a* of the fixed scroll may be mounted to one side of the fixed scroll 100. Some parts of the refrigerant that is being compressed may be discharged to the outside of the compression chamber 60 through the bypass port 105.

The bypass port 105 may allow the completely compressed refrigerant discharged from the discharge port 103 and some parts of a current compression refrigerant to be discharge to the outside of the fixed scroll 100, resulting in reduction of a discharge pressure formed in a discharge portion 140 through which refrigerant having passed through the compression chamber 60 is discharged.

Accordingly, it may be possible to adjust a difference between input pressure (introduction pressure) and output pressure (discharge pressure) formed in an introduction portion 150 configured in the inlet 104 introduced into the compression chamber 60, such that the compressor 1 efficiently operates.

The bypass port 106 may be located adjacent to the discharge port 103. One bypass port or two or more bypass ports may be used, as shown in FIG. 9.

The bypass passage 108 may pass through the range from an upper part of one side of the compression chamber 60 to an upper part of the fixed scroll 100, such that the outside of the fixed scroll 100 can communicate with the compression chamber 60. In other words, one end of the bypass passage 108 may be located at the upper end of one side of the compression chamber 60, and the bypass port 105 may be located at the other end of the bypass passage 108 extending from the one end of the bypass passage 108.

Before some parts of the refrigerant introduced into the compression chamber 60 move to the center part of the compression chamber 60, the parts of the refrigerant is discharged through the bypass port 105, such that the discharge pressure of the discharge portion 140 may be lower than another discharge pressure acquired when the bypass port 105 is not present.

A discharge valve 120 configured to open or close the discharge port 103 may be provided at the upper part of the discharge port 103. As a result, although a difference in pressure between the compression chamber 60 and the outside of the discharge port 103 is reduced when the compressor 1 stops driving, the discharge valve 120 may prevent high-temperature and high-pressure refrigerant from backflowing in the compression chamber 60 through the discharge port 103.

The discharge valve 120 may include a check valve 121 configured to move in an up-and-down direction at the upper part of the discharge port 103 according to the discharge of refrigerant, and a valve guide 122 configured to guide movement of the check valve 121. In addition, the discharge valve 120 may further include a buffering member (not shown) located at the uppermost surface 102*a* of the fixed scroll 100 and located below the check valve 121.

The valve guide 122 may guide a motion path of the check valve 121 in such a manner that the check valve 121 can move in an up-and-down direction (vertical direction). In more detail, the space in which the check valve 121 can move may be provided at the inside of the valve guide 122, and a motion path of the check valve 121 may be formed such that the check valve 121 can move in the vertical direction within the inner space of the valve guide 122.

The valve guide 122 may be bolt-coupled (bolted) to a fixed groove (not shown) provided on the uppermost surface 102*a* of the fixed scroll 100.

During the discharge process of refrigerant, the check valve 121 may perform reciprocating motion in the vertical direction at the upper part of the discharge port 103. The check valve 121 may move upward simultaneously with the discharge of such refrigerant. If the discharge of refrigerant is stopped, the check valve 121 may move downward such that the check valve 121 is located at the upper part of the discharge port 103 and contacts the uppermost surface 102*a*. As a result, the check valve 121 may open or close the discharge port 103. The check valve 121 may have an outer diameter through which the check valve 121 can cover the discharge port 103 when contacting the uppermost surface 102*a*.

A bypass valve 130 configured to open or close the bypass port 105 may be provided above the bypass port 105. The bypass valve 130 may be provided at the uppermost surface 102*a* of the fixed scroll 100. The bypass valve 130 may include a valve body 134 to open or close the bypass port 105, and a stopper 135 to limit motion of the valve body 134.

The valve body 134 may include a valve support portion 131 fixed thereto by a rivet. The valve support portion 131 may be formed in an approximately circular arc shape, and may also be coupled to the valve body 134 through not only by the rivet but also by a bolt or screw.

The valve body 134 may include a coupling portion 132 extending from one side of the valve support portion 131, and may include a body portion 133 to open or close the bypass port 105 at one end of the coupling portion 132.

If refrigerant is not discharged, the body portion 133 remains in contact with the uppermost surface 102*a*. If refrigerant is discharged to the bypass port 105 through the bypass passage 108, the refrigerant may move upward together with the discharged refrigerant. If the discharge of refrigerant is stopped, the refrigerant returns to the original position by the valve support portion 131 fixed to the uppermost surface 102*a*, and thus contacts the uppermost surface 102*a*. The body portion 133 may include an outer diameter to cover one or more bypass ports 105.

A stopper 135 having a predetermined size corresponding to the valve body 134 may be provided above the valve body 134. In the same manner as in the valve body 134, one side of the stopper 135 may include a portion to be riveted, and the stopper 135 may be formed to gradually move upward in a direction from one side to the other side thereof.

The other side of the stopper 135 is spaced apart from the body portion 133 by a predetermined distance, such that the body portion 133 may move upward when refrigerant is discharged. In more detail, the body may move upward until contacting the bottom surface of the stopper 135, and upward motion of the body portion 133 may be limited by the stopper 135.

Therefore, the stopper 135 and the body portion 133 may be spaced apart from each other by a predetermined distance through which the minimum amount of refrigerant can be discharged.

The fixed scroll 100 may include the uppermost surface 102*a* formed in the shape of a flat circular plate. Because the uppermost surface 102*a* of the fixed scroll 100 is formed flat, fabrication is simplified and additional post-processes need not be used, resulting in increased productivity of the fixed scroll 100. The discharge valve 120, the bypass valve 130, and the discharge guide 200 for covering the uppermost surface 102*a* of the fixed scroll 100 may be provided above the fixed scroll 100. An open-shaped guide portion 230 may be disposed at the center of the discharge guide 200 such that refrigerant discharged from the discharge port 103 and the bypass port 105 can flow into the discharge cover 80 through the discharge guide 200. The discharge guide 200 will hereinafter be described with reference to the attached drawings.

A back-pressure cover 300 may be disposed at the center of the discharge guide 200. The back-pressure cover 300 may perform reciprocating motion in the vertical direction by pressure of refrigerant flowing in a middle back-pressure chamber (also called a middle pressure chamber) 400 to be described later.

That is, the back-pressure cover 300 may perform reciprocating motion in the vertical direction.

That is, the back-pressure cover 300 formed to cover one side of the middle pressure chamber 400 may perform reciprocating motion in the vertical direction.

Referring to FIGS. 3 to 10, the back-pressure cover 300 may form the opening portion 301 in an upward direction, and may include a first ring-shaped wall 310 provided on the inner circumference formed by the opening portion 301. The first ring-shaped wall 310 may be formed to contact the outer circumference of the guide portion 230. When the back-pressure cover 300 moves in the vertical direction, the first ring-shaped wall 310 contacts the guide portion 230 and at the same time performs sliding motion in the vertical direction.

One side of the first ring-shaped wall 310 may include a first sealing member 360 for sealing the guide portion 230 and the first ring-shaped wall 310.

The first sealing member 360 may be seated in an uneven portion 370 formed in a concave shape at the first ring-shaped wall 310. The outer surface of the first sealing member 360 is formed to contact the guide portion 230, such that the first ring-shaped wall 310 and the guide portion 230 can be sealed during vertical motion of the back-pressure cover 300.

Although the first sealing member 360 is disposed between the guide portion 230 and the first ring-shaped wall 310 according to the embodiment, the first sealing member 360 may also be seated in the guide portion 230 without being seated in the first ring-shaped wall 310. In this case, the guide portion 230 may include a concave portion having a predetermined size corresponding to the size of the first sealing member 360.

The back-pressure cover 300 may include an inner circumference 340 formed in a ring-shaped wall shape extending from a lower part of the first ring-shaped wall 310 to one side of the fixed scroll 100, such that the back-pressure cover 300 can cover the discharge guide 200 and the uppermost surface 102*a* of the fixed scroll 100.

The inner circumference 340 may include a second ring-shaped wall 320 extending from the uppermost surface 102*a* of the fixed scroll 100 to one side of the body 102 located below the uppermost surface 102*a*.

In addition, an extension portion 350 extending from the outer circumference of the back-pressure cover 300 may be provided at the outside of the second ring-shaped wall 320 such that the extension portion 350 may correspond to the second ring-shaped wall 320 at the outer circumference of the back-pressure cover 300. Accordingly, the extension portion 350 may cover one side of the outer circumference of the fixed scroll 100.

A back-pressure cover guide 102*c*, which is formed to correspond to the second ring-shaped wall 320 and guides vertical motion of the back-pressure cover 300, may be provided at the outer circumference of the body 102.

The back-pressure cover guide 102*c* may be configured to contact the second ring-shaped wall 320, and may perform vertical motion on the condition that the second ring-shaped wall of the back-pressure cover 300 contacts the back-pressure cover guide 102*c*, such that overall vertical reciprocating motion of the back-pressure cover 300 may be guided.

As a result, the back-pressure cover guide 102*c* may guide vertical sliding motion of the back-pressure cover 300 on the condition that the back-pressure cover 300 and the upper part of the fixed scroll 100 maintain a closed state during the above-mentioned vertical motion.

A second sealing member 160 for sealing the back-pressure cover guide 102*c* and the second ring-shaped wall 320 may be disposed between the back-pressure cover guide 102*c* and the second ring-shaped wall 320. In more detail, the second sealing member 160 may be provided at the upper part of the back-pressure cover guide 102*c*, may be formed in a concave shape at the inner circumference of the fixed scroll 100, and may be seated in the seating member 102*b* formed along the outer wall of the uppermost surface 102*a* of the fixed scroll 100.

Therefore, the second sealing member 160 according to one embodiment may be formed to enclose the outer wall of the uppermost surface 102*a*.

The seating portion 102*b* may be disposed between the back-pressure cover guide 102*c* and the discharge guide 200 such that the sealing state is maintained even when the back-pressure cover 300 performs vertical sliding motion.

The second sealing member 160 may also be disposed over the back-pressure cover guide 102*c* without being limited to the above-mentioned embodiment. In this case, the sealing portion in which the second sealing member 160 is seated may be formed in a concave shape at the outer circumference of the back-pressure cover guide 102*c*.

As can be seen from FIG. 11, during operation of the compressor 1, refrigerant may be introduced into the compressor 1, and some parts of the refrigerant may be introduced into the middle-pressure chamber 400. Refrigerant introduced into the middle-pressure chamber 400 may allow the back-pressure cover 300 to be pressed in an upward direction by pressure as shown in FIG. 9, such that the back-pressure cover 300 may perform upward sliding motion.

A contact portion 330 provided at the upper end of the first ring-shaped wall 310 of the back-pressure cover 300 may contact the bottom surface of the discharge cover 80 through sliding motion, such that an opening 81 of the discharge cover 80 may communicate with the discharge portion 140 without a separation distance between the opening 81 and the discharge portion 140.

Therefore, high-pressure refrigerant discharged from the discharge port 103 and the bypass port 105 is not discharged with high pressure to the outside of the discharge guide 200 or to the outside of the back-pressure cover 300, and flows to the discharge cover 80, such that the high-pressure refrigerant may arrive at the high-pressure portion H.

If the compressor 1 stops operation, refrigerant of the compression chamber 60 and the middle-pressure chamber 400 may be discharged through the discharge port 103 as shown in FIG. 3, pressure of the middle-pressure chamber 400 is reduced, such that the back-pressure cover 300 may re-perform downward sliding motion. Therefore, a separation distance between the discharge cover 80 and the back-pressure cover 300 may occur again, a border between the high-pressure portion H and the low-pressure portion L disappears, such that a pressure difference may disappear from the main body 10. As a result, because the pressure difference may disappear from the main body 10, the orbiting scroll 50, which is configured to perform orbiting motion by pressure difference generated between the introduction portion 150 and the discharge portion 140, may stop operation.

The orbiting scroll 50 and the fixed scroll 100 are in contact with each other and at the same time perform orbiting motion, such that leakage of refrigerant between the orbiting scroll 50 and the fixed scroll 100 may occur and the issue of lubrication caused by frictional force between the orbiting scroll 50 and the fixed scroll 100 may also occur. In association with the frictional force between the orbiting scroll 50 and the fixed scroll 100, oil may flow between the orbiting scroll 50 and the fixed scroll 100 by the oil flow pipe 22, such that reliability of the compressor 1's operation is guaranteed.

Differently from the above-mentioned example, pressure may occur in the direction of separation between the orbiting scroll 50 and the fixed scroll 100 by the compression chamber 60 disposed between the orbiting scroll 50 and the fixed scroll 100, such that the refrigerant may leak to the outside of the compression chamber 60.

In order to prevent such leakage of refrigerant, the middle-pressure chamber 400 is formed at the upper part of the fixed scroll 100, such that the fixed scroll 100 may be pressed downward through pressure of refrigerant flowing into the middle-pressure chamber 400.

Because the fixed scroll 100 is pressed downward, the sealing state between the fixed scroll 100 and the orbiting 50 is maintained, such that reliability of the operation of the compressor 1 is guaranteed.

The middle-pressure chamber 400 may be formed by any of the outer circumference 200*a* of the discharge guide 200, the inner circumference 340 of the back-pressure cover 300, one side of the fixed scroll 100, and the second sealing member 160.

A middle-pressure chamber discharge port 106 may be provided at one side of the uppermost surface 102*a* of the fixed scroll 100 such that some parts of refrigerant applied to the compression chamber 60 may be introduced into the middle-pressure chamber 400.

Refrigerant discharged from the middle-pressure chamber discharge port 106 may pass through the discharge guide 200 such that the refrigerant may flow in the middle-pressure chamber 400. The fixed scroll 100 may include a middle-pressure chamber flow passage 109 through which the upper part of the compression chamber 60 communicates with the middle-pressure chamber discharge port 106. Some parts of refrigerant, which is compressed and flows toward the center part of the compression chamber 60 by the orbiting motion of the orbiting scroll 50, may be discharged to the middle-pressure chamber discharge port 106 through the middle-pressure chamber flow passage 109, and may be introduced into the middle-pressure chamber 400.

The discharge guide 200 will hereinafter be described with reference to the attached drawings.

Figure 12:
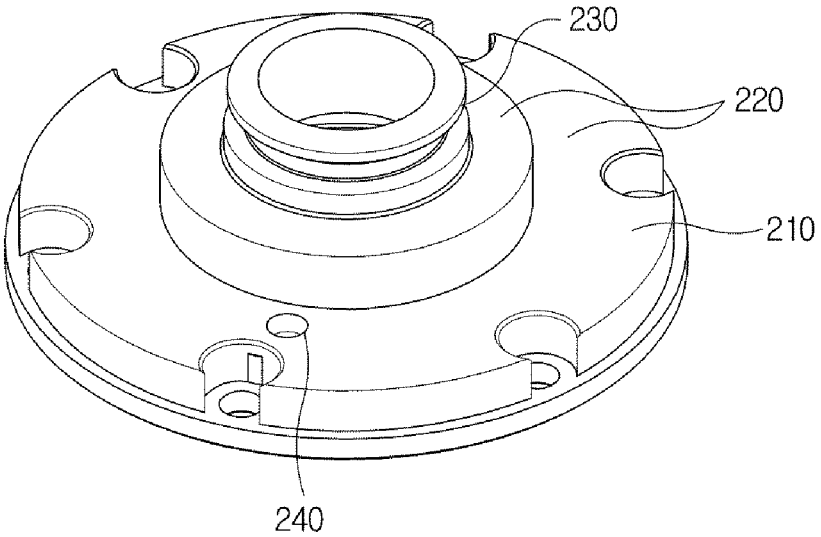
FIG. 12 is a perspective view illustrating a discharge guide of the compressor according to an embodiment of the present disclosure.
Figure 13:
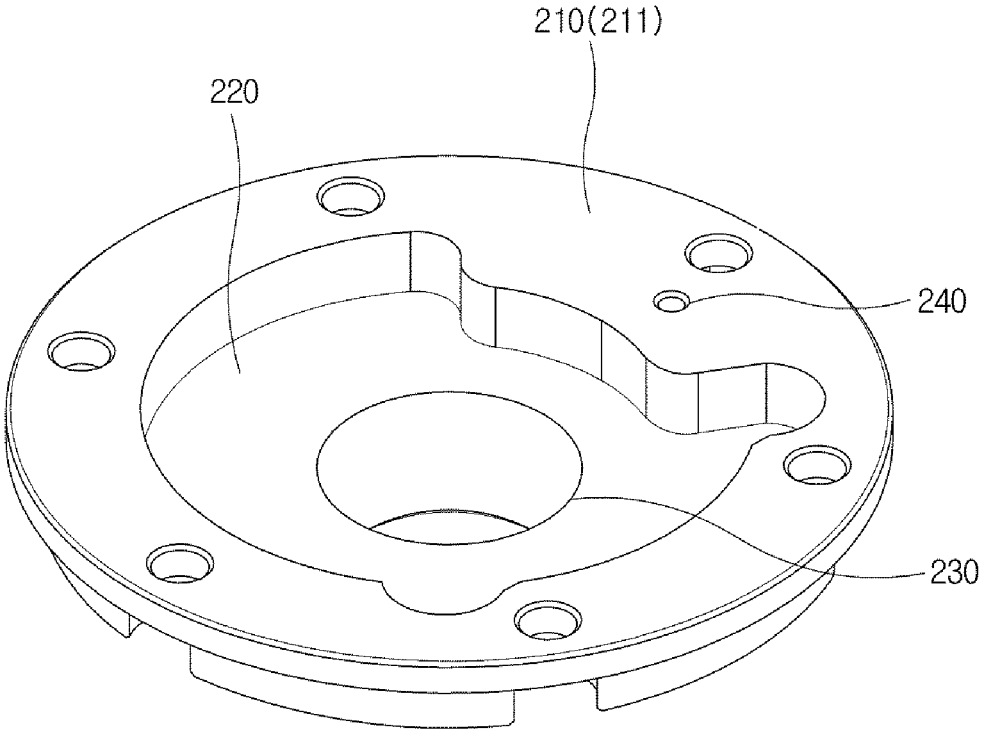
FIG. 13 is a rear perspective view of the compressor according to an embodiment of the present disclosure.

FIG. 12 is a perspective view illustrating a discharge guide of the compressor according to an embodiment of the present disclosure. FIG. 13 is a rear perspective view of the compressor according to an embodiment of the present disclosure.

Referring to FIGS. 12 and 13, the middle-pressure chamber 400 is provided at the upper part of the fixed scroll 100, such that there may be a spatial limitation in forming the bypass passage 108 and the bypass port 105.

When the middle-pressure chamber 400 is integrated with the fixed scroll 100, it may be impossible to form a predetermined-sized bypass passage 108, and it may also be impossible to arbitrarily establish the position of the bypass port 105 formed to communicate with the upper part of the fixed scroll 100.

The middle-pressure chamber 400 needs to be formed in a predetermined size to obtain a sufficiently high pressure at which the fixed scroll 100 can be pressed downward, and the middle-pressure chamber 400 needs to be provided at the appropriate position of the upper part of the fixed scroll 100.

In contrast, the middle-pressure chamber 400, the middle-pressure chamber 400, the discharge valve 120 for opening/closing the discharge port 103, and the bypass valve 130 for opening/closing the bypass port 105 must be provided at the upper part of the fixed scroll 100, such that it is difficult to effectively form the middle-pressure chamber 400 as well as to form the bypass passage 108 and the bypass port 105.

In order to address the above-mentioned issues, the compressor 1 may include a discharge guide 200 in a manner that the discharge valve 120, the bypass valve 130, the bypass passage 108, and the bypass port 105 contained in the related art are formed and at the same time a necessary space is effectively distributed thereto, resulting in formation of the middle-pressure chamber 400.

The discharge valve 120 and the bypass valve 130 are covered through the inside of the discharge guide 200, high-pressure refrigerant discharged from the discharge port 103 and the bypass port 105 flows into the discharge cover 80 simultaneously while being separated from the middle-pressure chamber 400, the outer surface 200*a* of the discharge guide 200 may construct some parts of the middle-pressure chamber 400, such that the middle-pressure chamber 400 can be formed while being separated from the high-pressure refrigerant.

Specifically, the discharge guide 200 is formed to cover both the discharge valve 120 and the bypass valve 130 such that the middle-pressure chamber 400 is separated from the above constituent elements, resulting in efficient operation of the compressor 1.

The discharge guide 200 may be separated from the fixed scroll 100. Because the discharge guide 200 is separated from the fixed scroll 100, the discharge guide 200 may be easily fabricated according to performance of the compressor 1 or the constituent elements covered by the discharge guide 200 as necessary.

The discharge guide 200 may be formed to contact the uppermost surface 102*a* of the fixed scroll 100, and may be coupled to the fixed scroll 100 using a bolt or screw. If necessary, the discharge guide 200 may be detachably coupled to the fixed scroll 100.

As described above, the discharge guide 200 may be formed at the upper part of the fixed scroll 100 to cover the discharge valve 120, the bypass valve 130, and the uppermost surface 102*a* of the fixed scroll 100.

The discharge guide 200 may be formed in a cover shape extended along the outer circumference thereof.

The open-shaped portion 230 may be disposed at the center of the discharge guide 200 such that refrigerant discharged from the discharge port 103 and the bypass port 105 can flow into the discharge cover 200 through the discharge guide 200.

The guide portion 230 may be formed in a ring-shaped cylinder shape including the opening therein. The guide portion 230 may extend upward from the center of the discharge guide 200.

The end portion of the opened part of the guide portion 230 may be located adjacent to the discharge cover 80. In addition, the outer circumference of the guide portion 230 may be formed to contact the first ring-shaped wall 310 of the back-pressure cover 300.

The guide portion 230 may be spaced apart from the opening 81 of the discharge cover 80 by a predetermined distance. During the operation of the compressor 1, the back-pressure 300 may slide upward such that separation between the guide portion 230 and the opening 81 can be sealed up. Therefore, the guide portion 230 and the opening 81 may communicate with each other while being in contact with each other, such that high-pressure refrigerant flows into the high-pressure portion H and may then be discharged to the outside of the main body 10.

The discharge guide 200 may include a first cover portion 210 formed in a predetermined size corresponding to the outer circumference of the uppermost surface 102*a* of the fixed scroll 100 such that the uppermost surface 102*a* of the fixed scroll 100 is covered.

The first cover portion 210 may range from the outer circumference of the discharge guide 200, and may be formed in a space located adjacent to the outer circumference of the discharge guide 200. The first cover portion 210 may be formed to cover an approximately entire region of the uppermost surface 102*a* of the fixed scroll 100.

As shown in FIG. 13, the first cover portion 210 may include the contact portion 211 in which all regions contact the uppermost surface 102*a* of the fixed scroll 100. The contact portion 211 and the uppermost surface 102*a* may be in close contact with each other without a separation distance therebetween, such that that the inside of the discharge guide 200 in which the discharge passage 107 and the discharge cover 80 communicate with each other may be sealed from the outside of the discharge guide 200 in which the middle-pressure chamber 400 is formed.

The outer wall of the first cover portion 210 may be formed in a cylindrical shape through which one side of the second sealing member 160 enclosing the outer wall of the uppermost surface 102*a* can be covered.

Figure 15:
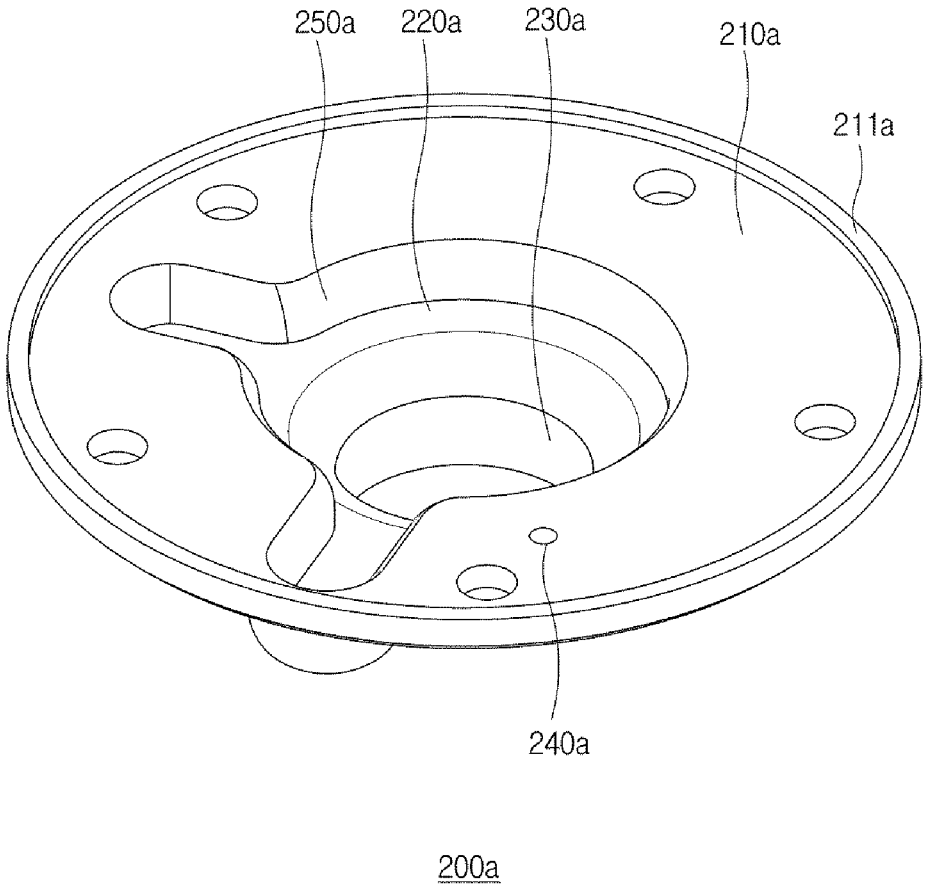
FIG. 15 is a rear perspective view illustrating the discharge guide of the compressor according to an embodiment of the present disclosure.

However, the scope or spirit of the first cover portion 210 is not limited only to one embodiment of the present disclosure, and only some parts of the first cover portion 210 may be formed as the contact portion 211 as shown in FIG. 15, and the first cover portion 210 other than the contact portion 211 may extend from the contact portion 211 in a separation direction in which the first cover portion 210 is separated upward from the fixed scroll 100. The discharge guide 200 may include a second cover portion 220 extending from the first cover portion to the center part. The second cover portion 220 may be located at the position corresponding to the discharge valve 120 and the bypass valve 130, and may cover a contiguous section between the discharge valve 120 and the bypass valve 130.

The second cover portion 220 may extend upward from the inner circumference of the first cover portion 210, and may be formed in a ring-shaped wall shape. The above-mentioned guide portion 230 may be located at the inner circumference of the second cover portion 220.

A pass-through portion 240 may be provided at the position corresponding to the middle-pressure chamber discharge port 106 of the first cover portion 210. Refrigerant flowing into the discharge guide 200 is identical to refrigerant discharged from the discharge port 103 and the bypass port 105, and has a higher pressure than the middle-pressure chamber discharge port 106. In order to maintain such pressure difference, refrigerant flowing into the middle-pressure chamber 400 can be separated from refrigerant flowing into the discharge guide 200.

The pass-through portion 240 may be formed to pass through the space between the inner surface and the outer surface of the first cover portion 210. One end of the pass-through portion 240 provided at the inner surface of the first cover portion 210 is formed to seal the middle-pressure chamber discharge port 106, such that middle-pressure refrigerant does not flow into the discharge guide 200.

The inside of the second cover portion 220 of the discharge guide 200 may be integrated with the discharge valve 12 in a different way from the above-mentioned embodiment. That is, the discharge guide 200 may be integrated with the discharge valve 120 in an assembly form.

The upper part of the valve guide 122 is integrated with the inside of the second cover portion 220, such that the discharge guide 200 is seated on the fixed scroll 100 and at the same time the discharge valve 120 can also be seated on the uppermost surface 102*a*. The discharge guide 200*a* of the compressor 1 according to an embodiment of the present disclosure will hereinafter be given. The remaining constituent elements other than the following elements to be described are identical to those of the compressor 1 according to the above-mentioned embodiment, and as such a detailed description thereof will herein be omitted for convenience.

Figure 14:
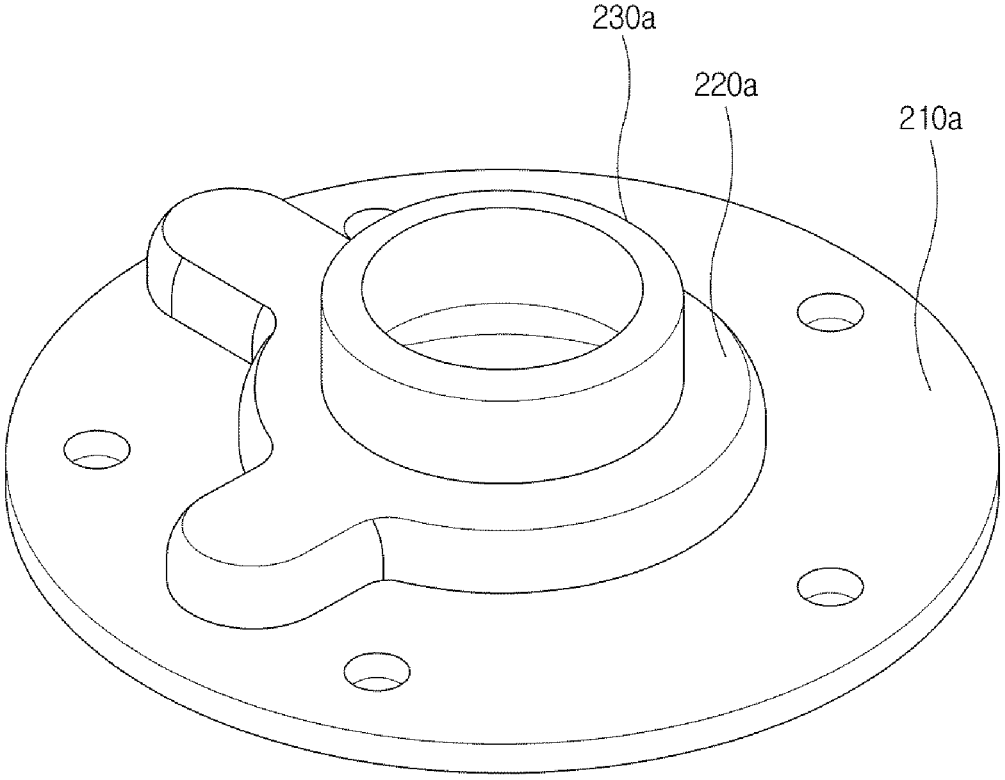
FIG. 14 is a perspective view illustrating a discharge guide of a compressor according to an embodiment of the present disclosure.

FIG. 14 is a perspective view illustrating a discharge guide of a compressor according to an embodiment of the present disclosure. FIG. 15 is a rear perspective view illustrating the discharge guide of the compressor according to an embodiment of the present disclosure.

Referring to FIG. 14, the second cover portion 220*a* of the discharge guide 200*a* may protrude upward from the first cover portion 210*a* such that the second cover portion 220*a* may include a curved surface. In addition, the second cover portion 220*a* may be provided at the region corresponding to the discharge valve 120 and the bypass valve 130.

In addition, the second cover portion 220*a* is not limited thereto, and may also be formed in other shapes as necessary.

Referring to FIG. 15, the second cover portion 220*a* may include a rounding portion 250*a* formed to have a curved surface.

Each of the discharge valve 120 and the bypass valve 130 located at the inside of the discharge guide 200*a* may be formed in a shape of a valve configured to perform vertical motion by discharge of refrigerant, such that the valve-shaped valve may strike the uppermost surface 102*a* of the fixed scroll 100 during the vertical motion. In this case, the valve strikes the uppermost surface 102*a* of the fixed scroll 100, resulting in the occurrence of noise and pulsation.

In order to reduce noise and pulsation generated from the uppermost surface 102*a* of the fixed scroll 100, the discharge guides (200, 200*a*) may cover the entire uppermost surface 102*a* of the fixed scroll 100. In more detail, the first cover portion (210, 210*a*) may be formed to have a predetermined size corresponding to the outer circumference of the uppermost surface 102*a* of the fixed scroll 100.

The discharge valve 120 and the bypass valve 130 in which noise and pulsation occur may be covered with the second cover portion 220*a*. In order to reduce noise and pulsation generated from the part adjacent to the second cover portion 220*a*, the second cover portion 220*a* may include a rounding portion 250*a*.

The rounding portion 250*a* is located adjacent to the part in which noise and pulsation occur, such that the noise and pulsation are reflected in a diffused manner, resulting in reduction of noise and pulsation.

The second cover portion 220*a* and the guide portion 230*a* may be formed in a curved shape, resulting in reduction of noise and pulsation.

The first cover portion 210*a* may include a contact surface 211*a* formed along the outline of the discharge guide 200*a*. The first cover portion 210*a* other than the contact surface 211*a* may be separated from the upper part of the contact surface 211*a* by a predetermined distance, such that the first cover portion 210*a* may be spaced apart from the uppermost surface 102*a* of the fixed scroll 100. A pass-through portion 240*a* may be provided at the position corresponding to the middle-pressure chamber discharge port 106 of the first cover portion 210.

The discharge guides (200*b*, 200*c*, 200*d*) of the compressor 1 according to an embodiment of the present disclosure will hereinafter be described. The remaining constituent elements other than the following elements to be described are identical to those of the compressor 1 according to the above-mentioned embodiment, and as such a detailed description thereof will herein be omitted for convenience.

Figure 16:
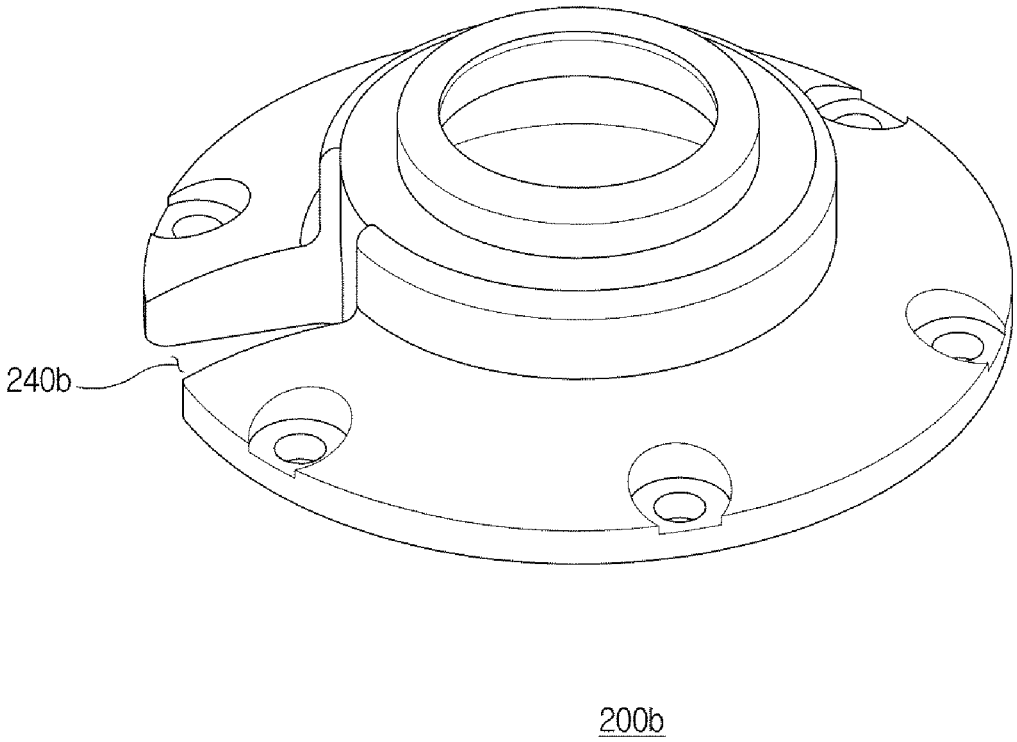
FIG. 16 is a perspective view illustrating a compressor according to an embodiment of the present disclosure.
Figure 17:
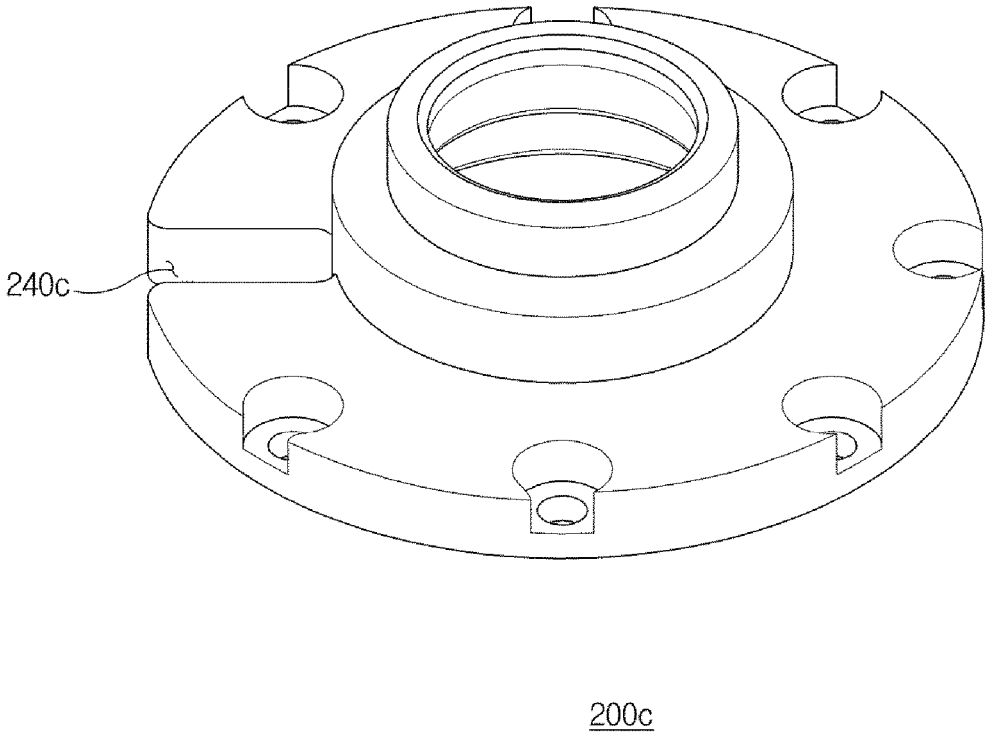
FIG. 17 is a perspective view illustrating a compressor according to an embodiment of the present disclosure.
Figure 18:
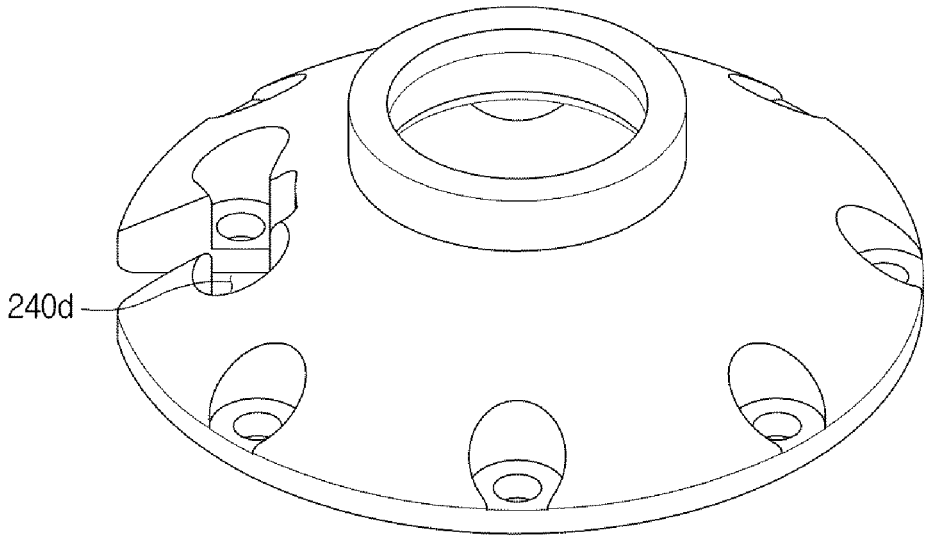
FIG. 18 is a perspective view illustrating a compressor according to an embodiment of the present disclosure.

FIGS. 16 to 18 are perspective views illustrating a compressor according to an embodiment of the present disclosure.

Referring to FIG. 16, the discharge guide 200*b* may include a pass-through portion 240*b*. The pass-through portion 240*b* may be configured in a manner that one side of the discharge guide 200*b* is cut or severed.

Assuming that the pass-through portion 240 is formed in a tube shape, the pass-through portion 240 must be assembled at the position correctly corresponding to the middle-pressure chamber discharge port 106 in a manner that the middle-pressure chamber discharge port 106 is sealed up.

However, the discharge guide 200 may be separated from the fixed scroll 100 and may be assembled with another through a screw or bolt, as described above. If separation or the like occurs in the assembling process, the pass-through portion 240 may incorrectly coincide with the middle-pressure chamber discharge port 106.

Therefore, leakage of middle-pressure refrigerant occurs, and the middle-pressure refrigerant flows into the discharge guide 200 and may be mixed with high-pressure refrigerant flowing into the discharge guide 200, resulting in reduction of operation reliability of the compressor 1.

In order to prevent the above-mentioned issues, the pass-through portion 240*b* may be formed in a manner that one side of the discharge guide 200*b* is severed or cut. The part severed by the pass-through portion 240*b* may allow one side of the uppermost surface 102*a* of the fixed scroll 100 to directly contact the middle-pressure chamber 400.

The middle-pressure chamber discharge port 106 may be provided at one side of the uppermost surface 102*a* contacting the middle-pressure chamber 400, such that refrigerant discharged from the middle-pressure chamber discharge port 106 may flow into the middle-pressure chamber 400 after passing through the discharge guide 200*b* through the severed part.

The pass-through portion 240*b* may be severed in a manner that the outer diameter thereof is larger than that of the middle-pressure chamber discharge port 106. If separation of a predetermined part may occur in the assembling process of the discharge guide 200*b*, some parts of the middle-pressure chamber discharge port 106 may be limited, such that the outer diameter of the pass-through portion 240*b* is larger than that of the middle-pressure chamber discharge port 106.

Therefore, although such separation unavoidably occurs in the assembling process of the discharge guide 200*b*, middle-pressure refrigerant may easily pass through the discharge guide 200*b* and then flow into the middle-pressure chamber 400.

Referring to FIG. 17, the pass-through portion 240*b* may be severed (or cut) in various shapes. The shape of the pass-through portion 240*d* is not limited only to the embodiments in terms of the size or performance of the compressor 1, and may also be formed in various shapes as necessary without departing from the scope or spirit of the present disclosure.

Referring to FIG. 18, the part adjacent to the pass-through portion 240*d* may further include a screw- or bolt-coupling groove to guarantee a sealing state of the discharge guide 200*d*. One side of the discharge guide 200*d* is severed such that no coupling groove is present and a predetermined separation may occur. Thus, one or more additional coupling grooves may be formed at the indoor space (i.e., spacing formed by the severed discharge guide 200*d*) of the pass-through portion 240*d*, resulting in increased sealing capability.

In addition, there is no step difference between the first cover portion 210 and the second cover portion 220 through the discharge guide 200*d*. As the discharge guide 200*d* moves closer to the center point of the discharge guide 200*d* through an inclined plane, the discharge guide 200*d* is formed to more protrude upward.

Figure 19:
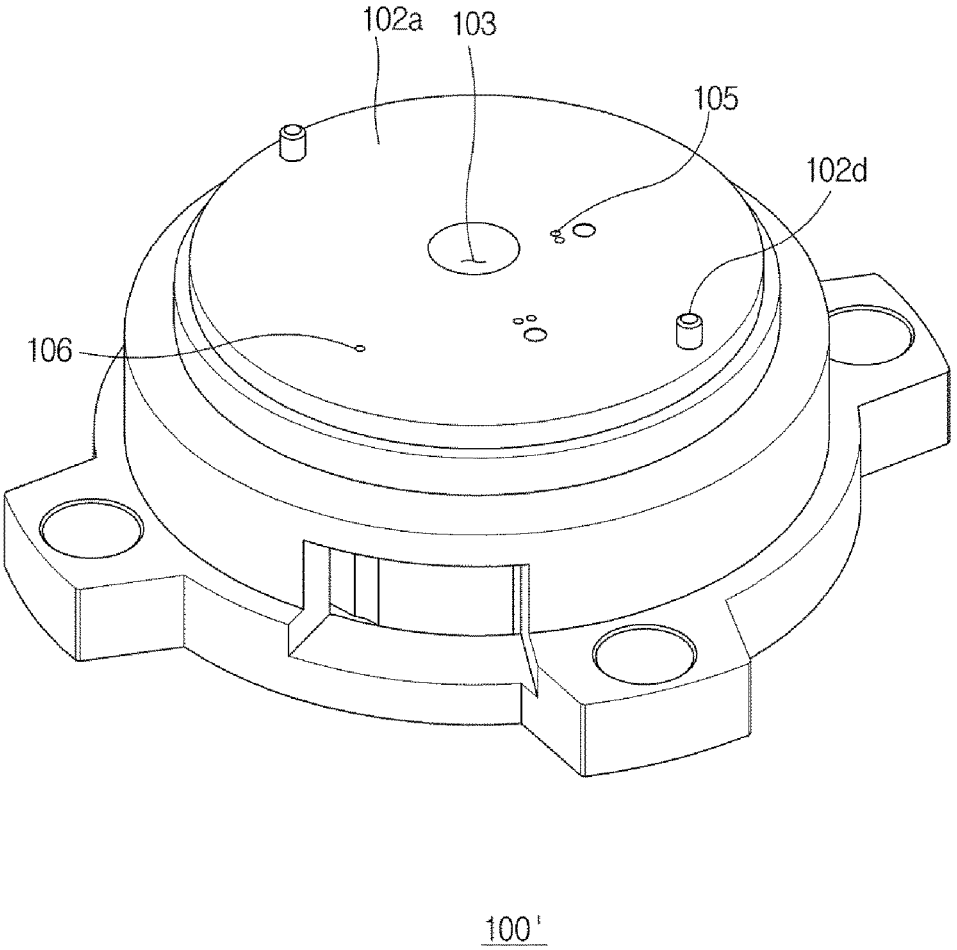
FIG. 19 is a perspective view illustrating a fixed scroll of a compressor according to an embodiment of the present disclosure.

Referring to FIG. 19, a fixed scroll 100' according to an embodiment may include a reference pin 102*d* disposed on the uppermost surface 102*a'*.

As described above, the discharge guide 200 must be independently separated from the fixed scroll 100 and must be additionally assembled with the fixed scroll 100. In this case, the pass-through portion 240 of the discharge guide 200 must be assembled at the position corresponding to the middle-pressure chamber discharge port 106 disposed on the uppermost surface 102*a*.

The fixed scroll 100 may include the reference pin 102*d* to prevent the occurrence of an incomplete assembling process of the discharge guide 200. In more detail, in the incomplete assembling process, the discharge guide 200 may be assembled on the condition that the middle-pressure chamber discharge port 106 is not arranged at the position corresponding to the pass-through portion 240 due to slight motion of the discharge guide 200.

The reference pin 102*d* may be formed in a shape of a protrusion formed to protrude upward from the uppermost surface 102*a*. The reference pin 102*d* is not limited only to the embodiments, two or more reference pins may also be used as necessary, and the arrangement position(s) of the reference pin(s) 102*d* may be determined at random.

An insertion groove (not shown) in which the reference pin 102 can be inserted may be additionally provided at the inside of the discharge guide 200, such that the discharge guide 200 can be fixed to the fixed scroll 100 prior to assembling of the discharge guide 200.

The fixed scroll 100' and the back-pressure cover 300' of the compressor 1 according to an embodiment will hereinafter be described with reference to the attached drawings. The remaining constituent elements other than the following elements to be described are identical to those of the compressor 1 according to the above-mentioned embodiment, and as such a detailed description thereof will herein be omitted for convenience.

Figure 20:
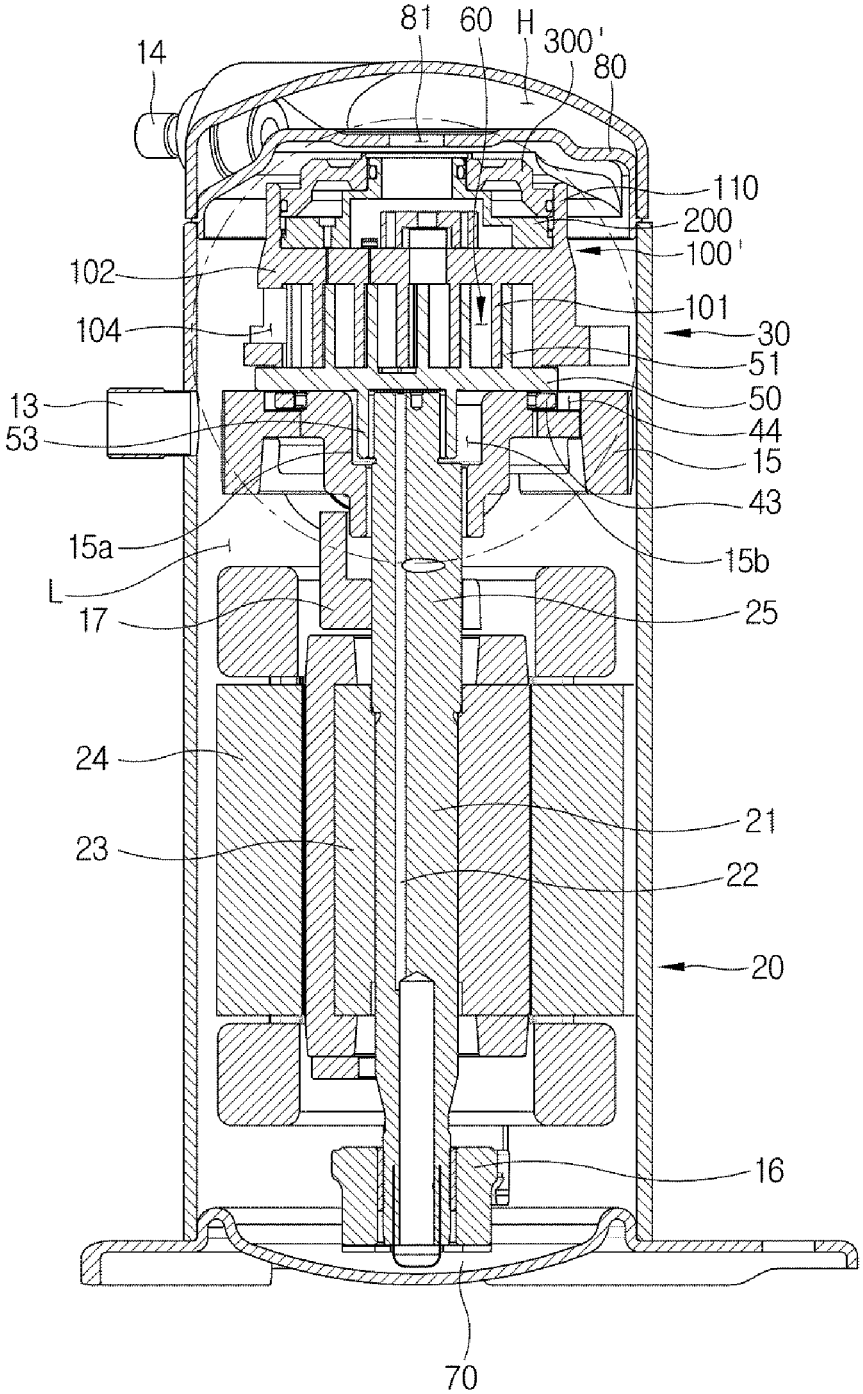
FIG. 20 is a side cross-sectional view illustrating a compressor according to an embodiment of the present disclosure.
Figure 21:
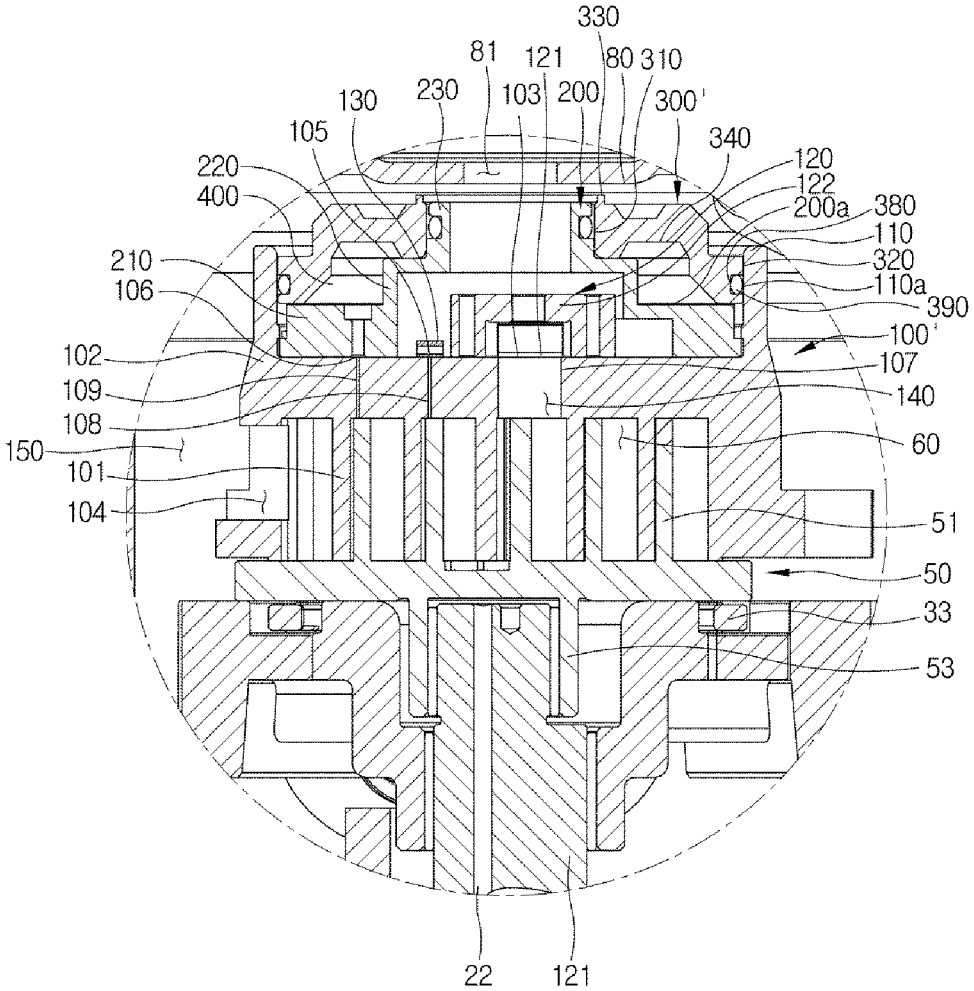
FIG. 21 is an enlarged side cross-sectional view illustrating some constituent elements of the compressor according to an embodiment of the present disclosure.
Figure 22:
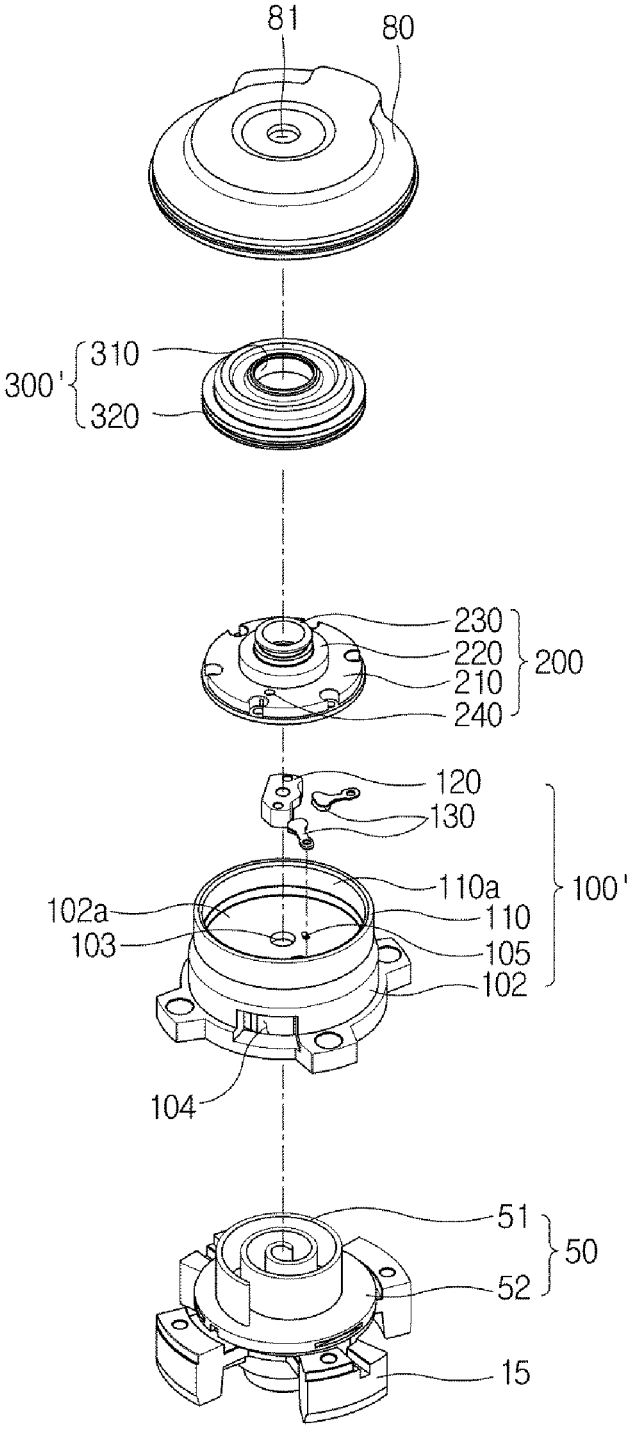
FIG. 22 is an exploded perspective view illustrating some constituent elements of a compressor according to an embodiment of the present disclosure.
Figure 23:
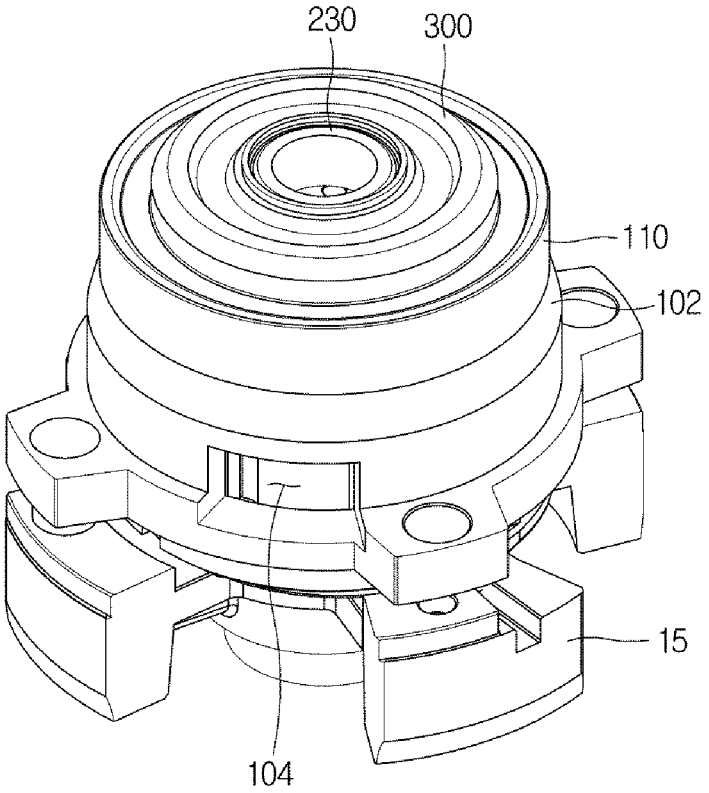
FIG. 23 is a perspective view illustrating some constituent elements of a compressor according to an embodiment of the present disclosure.
Figure 24:
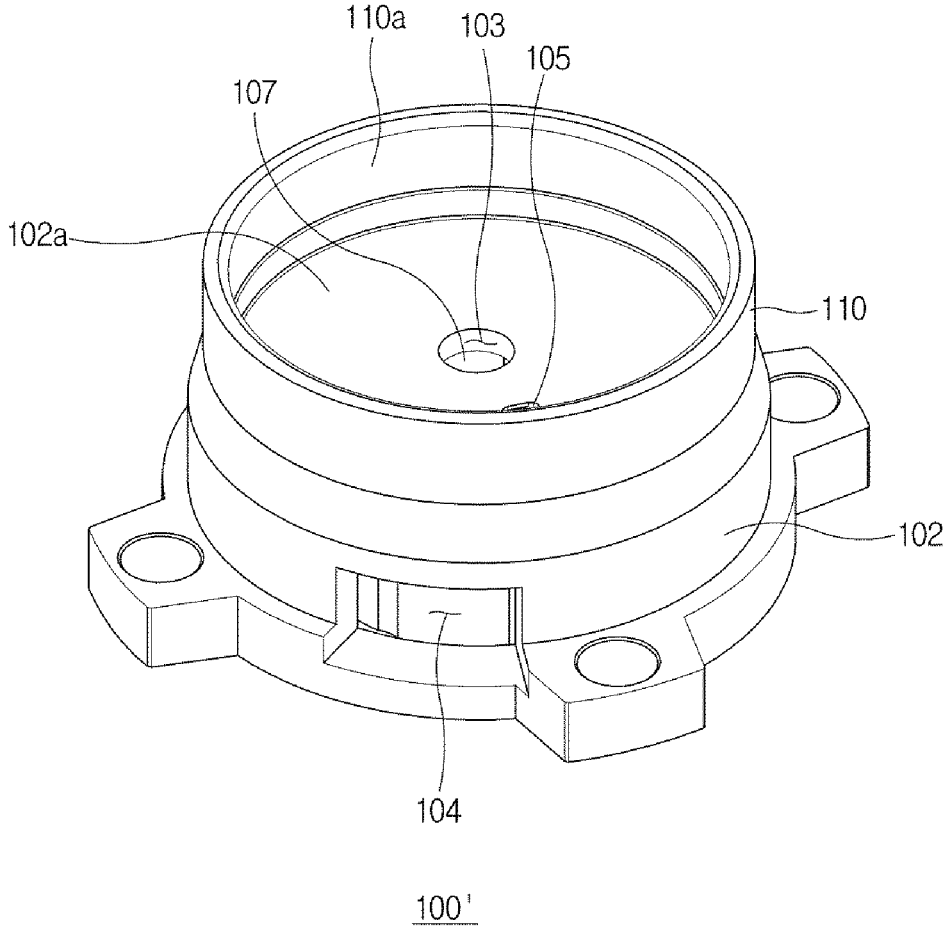
FIG. 24 is a perspective view illustrating a fixed scroll of a compressor according to an embodiment of the present disclosure.
Figure 25:
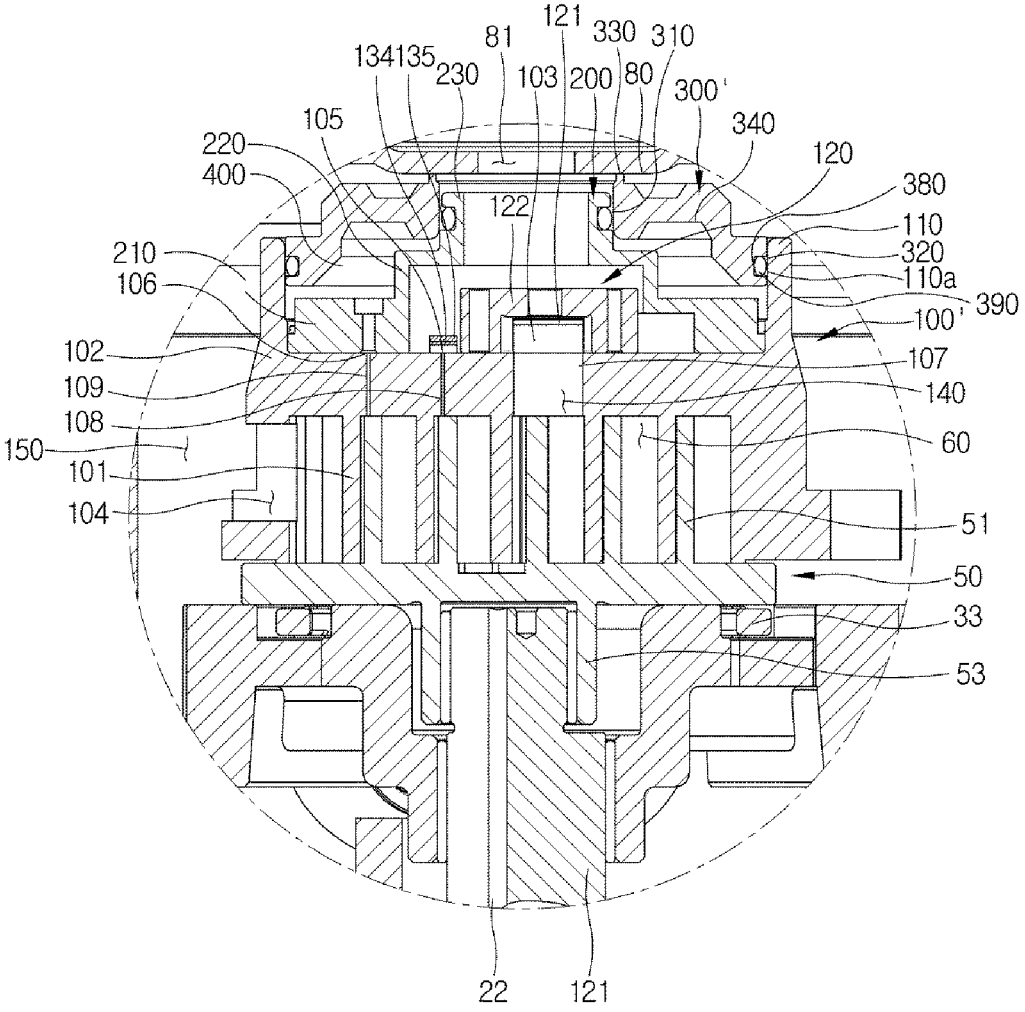
FIG. 25 is an enlarged side cross-sectional view illustrating some constituent elements of a compressor according to an embodiment of the present disclosure.

FIG. 20 is a side cross-sectional view illustrating a compressor according to an embodiment of the present disclosure. FIG. 21 is an enlarged side cross-sectional view illustrating some constituent elements of the compressor according to an embodiment of the present disclosure. FIG. 22 is an exploded perspective view illustrating some constituent elements of the compressor according to an embodiment of the present disclosure. FIG. 23 is a perspective view illustrating some constituent elements of the compressor according to an embodiment of the present disclosure. FIG. 24 is a perspective view illustrating a fixed scroll of the compressor according to an embodiment of the present disclosure. FIG. 25 is an enlarged side cross-sectional view illustrating some constituent elements of the compressor according to an embodiment of the present disclosure.

As can be seen from FIGS. 20 to 24A ring-shaped middle-pressure wall 110 protruding upward from the fixed scroll 100' may be provided at the outer circumference of the uppermost surface 102*a*' of the fixed scroll 100'. The middle-pressure wall 110 may be integrated with the body 102.

The inner circumference 110*a* of the middle-pressure wall 110 may contact the outer circumference of the discharge guide 200, and may guide vertical sliding motion of the back-pressure cover 300.

The back-pressure cover 300' may include a second ring-shaped wall 320' provided at the outer circumference thereof.

The second ring-shaped wall 320' may be provided at the outer circumference of the back-pressure cover 300'.

Therefore, the second ring-shaped wall 320' may contact the inner circumference 100*a* of the middle-pressure wall 110. During vertical motion of the back-pressure cover 300', the second ring-shaped wall 320' may perform vertical sliding motion while being in contact with the inner circumference 110*a* of the middle-pressure wall 110. As a result, when the back-pressure cover 300 performs vertical motion, the middle-pressure wall 110 may guide sliding motion of the back-pressure cover 300.

Alternatively, the back-pressure cover 300' may not include the extension portion 350 and the back-pressure cover guide 102*c*. Instead of the extension portion 350 and the back-pressure cover guide 102*c*, vertical motion of the back-pressure cover 300' may be guided by the middle-pressure wall 110.

An uneven portion formed in a concave shape may be provided at the inside of the second ring-shaped wall 320', and a second sealing member 390 for sealing the back-pressure cover 300' and the middle-pressure wall 110 may be provided in the uneven portion 380.

Differently from the second sealing member 160 according to one embodiment, the second sealing member 390 according to an embodiment may seal the spacing between the second ring-shaped wall 320' and the middle-pressure wall 110 during the sliding motion of the back-pressure cover 300', because the fixed scroll 100' according to an embodiment does not include the back-pressure cover guide 102*c* and includes the middle-pressure wall 110 instead of the back-pressure cover guide 102*c*.

The outer surface of the second sealing member 390 may contact the inner circumference 110*a* of the middle-pressure wall 110, such that the second ring-shaped wall 310 and the inner circumference 110*a* can be sealed during vertical sliding motion of the back-pressure cover 300'.

As can be seen from FIG. 25, the middle-pressure chamber 400 may be formed by the outer circumference 200*a* of the discharge guide 200, the inner circumference 110*a* of the middle-pressure wall 110, and the inner circumference 340' of the back-pressure cover 300'. The above-mentioned constituent elements may form the middle-pressure chamber 400, such that the constituent elements may press the fixed scroll 100 in a downward direction.

A sealing structure of the fixed scroll 100 and the discharge guide 200 of the compressor 1 according to an embodiment of the present disclosure will hereinafter be described with reference to the attached drawings. The remaining constituent elements other than the following elements to be described are identical to those of the compressor 1 according to the above-mentioned embodiment, and as such a detailed description thereof will herein be omitted for convenience.

Figure 26:
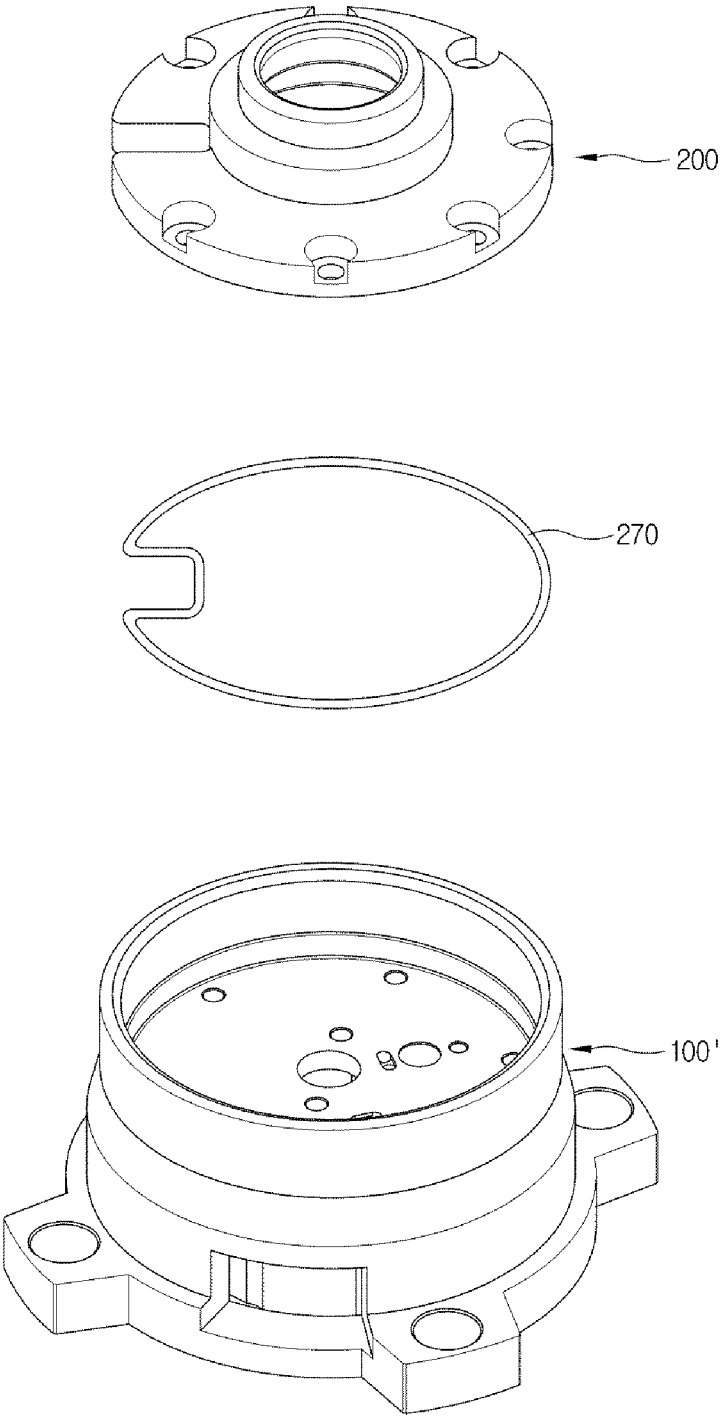
FIG. 26 is an exploded perspective view illustrating some constituent elements of a back-pressure cover of a compressor according to an embodiment of the present disclosure.
Figure 27:
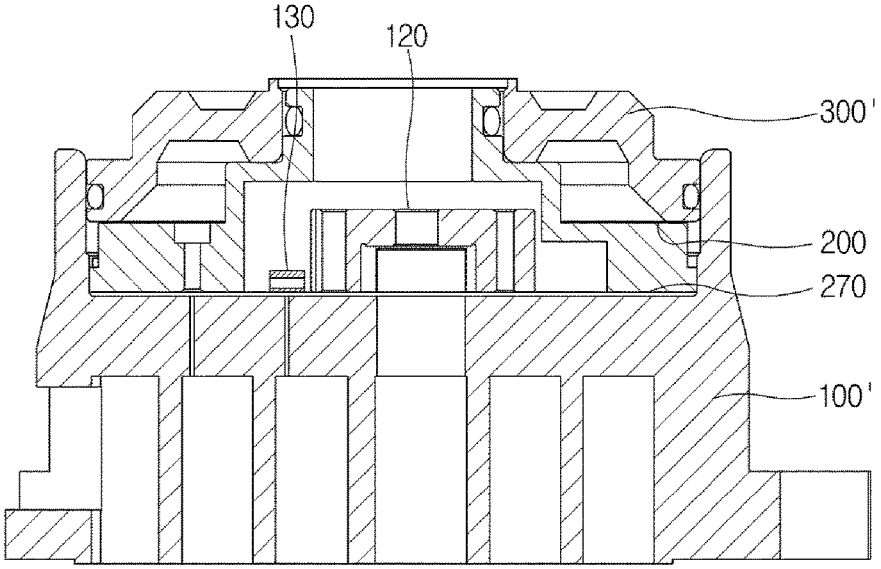
FIG. 27 is a side cross-sectional view illustrating some constituent elements of a compressor according to an embodiment of the present disclosure.
Figure 28:
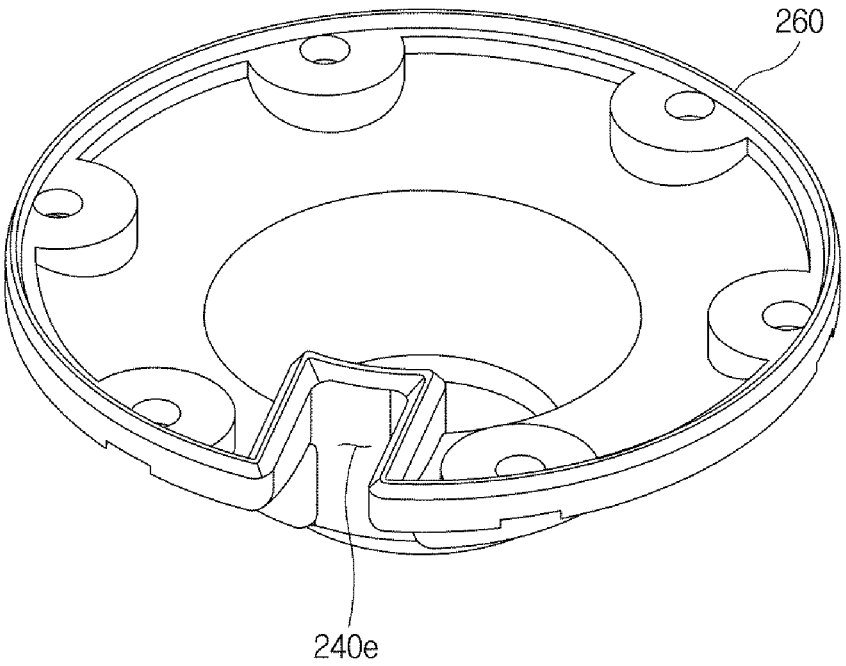
FIG. 28 is a rear perspective view illustrating a discharge guide of the compressor according to an embodiment of the present disclosure.
Figure 29:
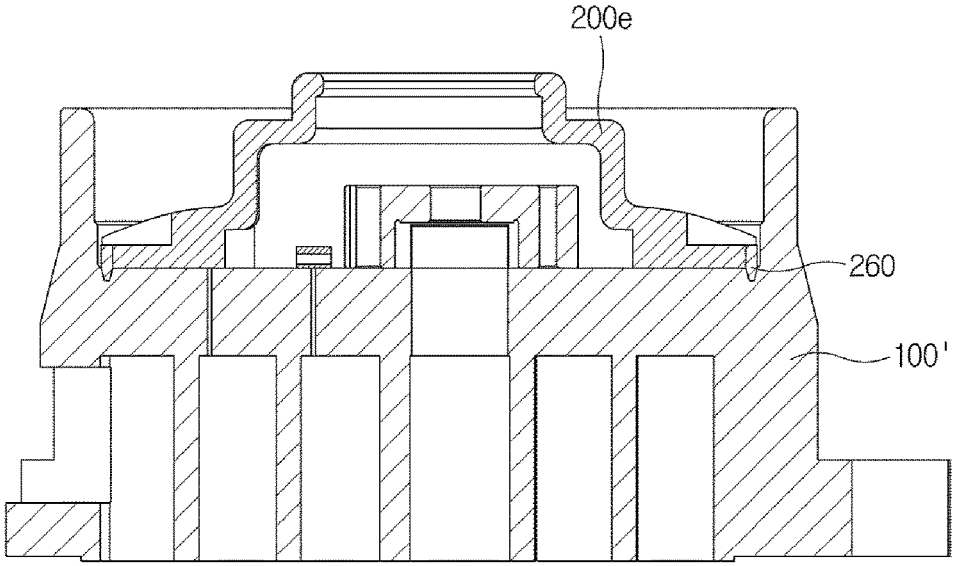
FIG. 29 is a side cross-sectional view illustrating some constituent elements of a compressor according to an embodiment of the present disclosure.

FIG. 26 is an exploded perspective view illustrating some constituent elements of the compressor according to an embodiment of the present disclosure. FIG. 27 is a side cross-sectional view illustrating some constituent elements of the compressor according to an embodiment of the present disclosure. FIG. 28 is a rear perspective view illustrating a discharge guide of the compressor according to an embodiment of the present disclosure. FIG. 29 is a side cross-sectional view illustrating some constituent elements of the compressor according to an embodiment of the present disclosure.

As described above, the discharge guide 200 and the fixed scroll 100' may be sealed and then assembled with each other. If separation between the discharge guide 200' and the fixed scroll 100 occurs, high-pressure refrigerant discharged from the discharge port 103 and the bypass port 105 may flow into the low-pressure portion L or the middle-pressure chamber 400, resulting in reduction of operation reliability of the compressor 1.

In order to prevent the above-mentioned issues, the compressor 1 may include a third sealing member 270 to increase contact force between the discharge guide 200 and the fixed scroll 100, as shown in FIGS. 26 and 27. The third sealing member 270 may be disposed between the contact surface 211 of the discharge guide 200 and the uppermost surface 102*a* of the fixed scroll 100, to seal the discharge guide 200 an the fixed scroll 100. In this case, the third sealing member 270 may be formed in a gasket shape.

The third sealing member 270 may be formed in a corresponding shape at the outer wall of the discharge guide 200. That is, assuming that the pass-through portion 240 is formed in a hole shape, the third sealing member 270 may be formed in a ring shape. If the pass-through portion 240 is formed in a shape in which one side of the discharge guide 200 is severed, the third sealing member 270 may be formed in a shape corresponding to the severed shape of the discharge guide 200.

Although not shown in the drawings, instead of using the gasket shape according to one embodiment of the third sealing member 270, sealing force between an exterior-angle part of the discharge guide 200 and the uppermost surface 102*a* of the fixed scroll 100 corresponding to the exterior-angle part may increase through additional taping.

The fixed scroll 100' may also be applied to the fixed scroll 100 according to the above-mentioned embodiment, and the discharge guide 200 may also be applied to the discharge guides (200*a*, 200*b*, 200*c*, 200*d*) according to the above-mentioned embodiments without departing from the scope or spirit of the present disclosure.

Referring to FIGS. 28 and 29, a pressing protrusion 260 may be provided at the lower end of the discharge guide 200*e*. In more detail, the pressing protrusion 260 may be formed in a protrusion formed to protrude downward from the contact surface 211 of the discharge guide 200.

The uppermost surface 102 of the fixed scroll 100 is formed to contact the lower end of the discharge guide 200*e* such that each constituent element is sealed up. The bottom end of the discharge guide 200*e* contacts the uppermost surface 102 due to the presence of the pressing protrusion 260, and at the same time the pressing protrusion 260 is inserted in the inner direction of the fixed scroll 100, resulting in increased sealing force between the fixed scroll 100 and the discharge guide 200*e*.

A pass-through portion 240*e* may be provided at the position corresponding to the middle-pressure chamber discharge port 106.

Referring to FIG. 29, the press-in groove formed in the fixed scroll 100 may be provided at the position corresponding to the pressing protrusion 260 of the discharge guide 200*e* at the uppermost surface 102*a* of the fixed scroll 100, such that a pressing protrusion 260 may be inserted into the press-in groove.

The bypass passage 108' and the bypass port 105' of the compressor 1 according to an embodiment will hereinafter be described. The remaining constituent elements other than the following elements to be described are identical to those of the compressor 1 according to the above-mentioned embodiment, and as such a detailed description thereof will herein be omitted for convenience.

Figure 30:
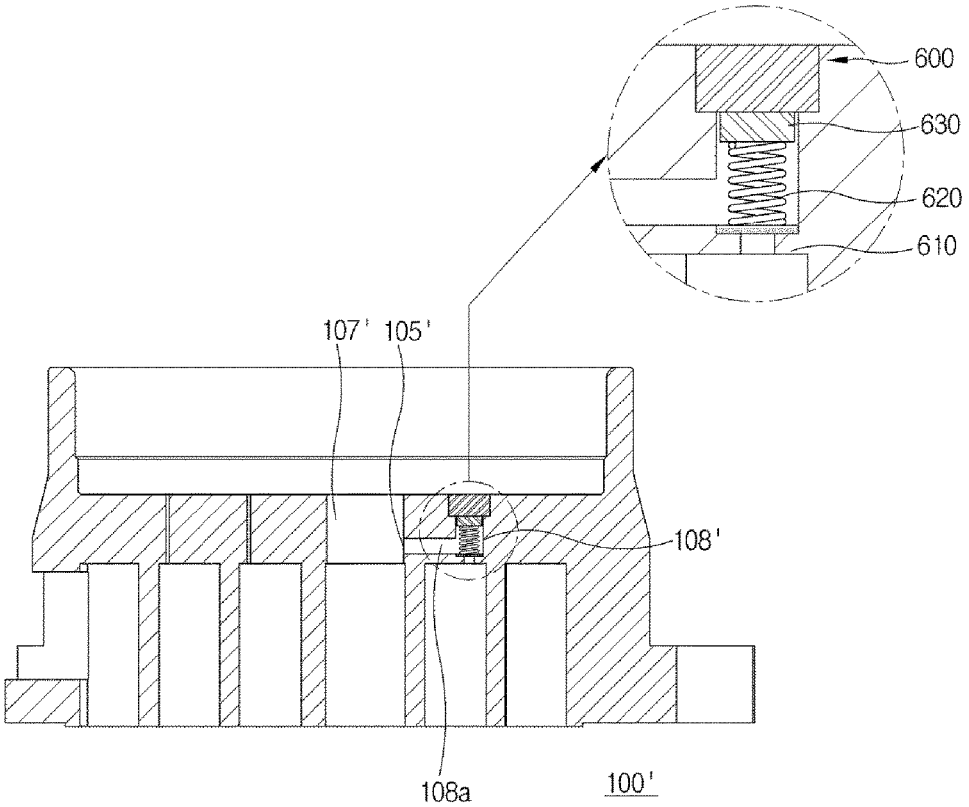
FIG. 30 is a side cross-sectional view illustrating some constituent elements of a compressor according to an embodiment of the present disclosure.
Figure 31:
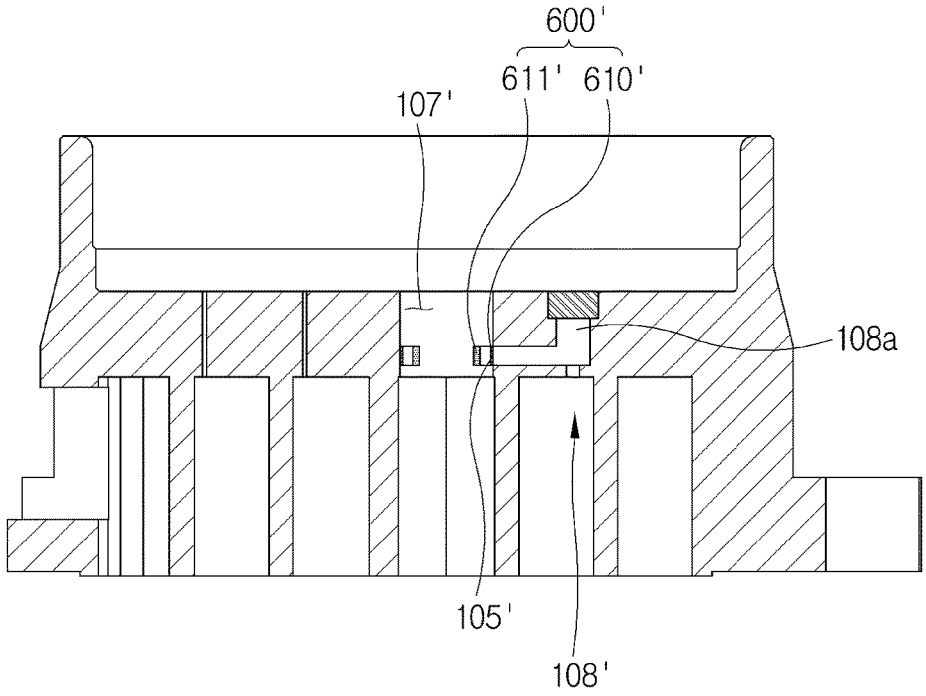
FIG. 31 is a side cross-sectional view illustrating some constituent elements of a compressor according to an embodiment of the present disclosure.
Figure 32:
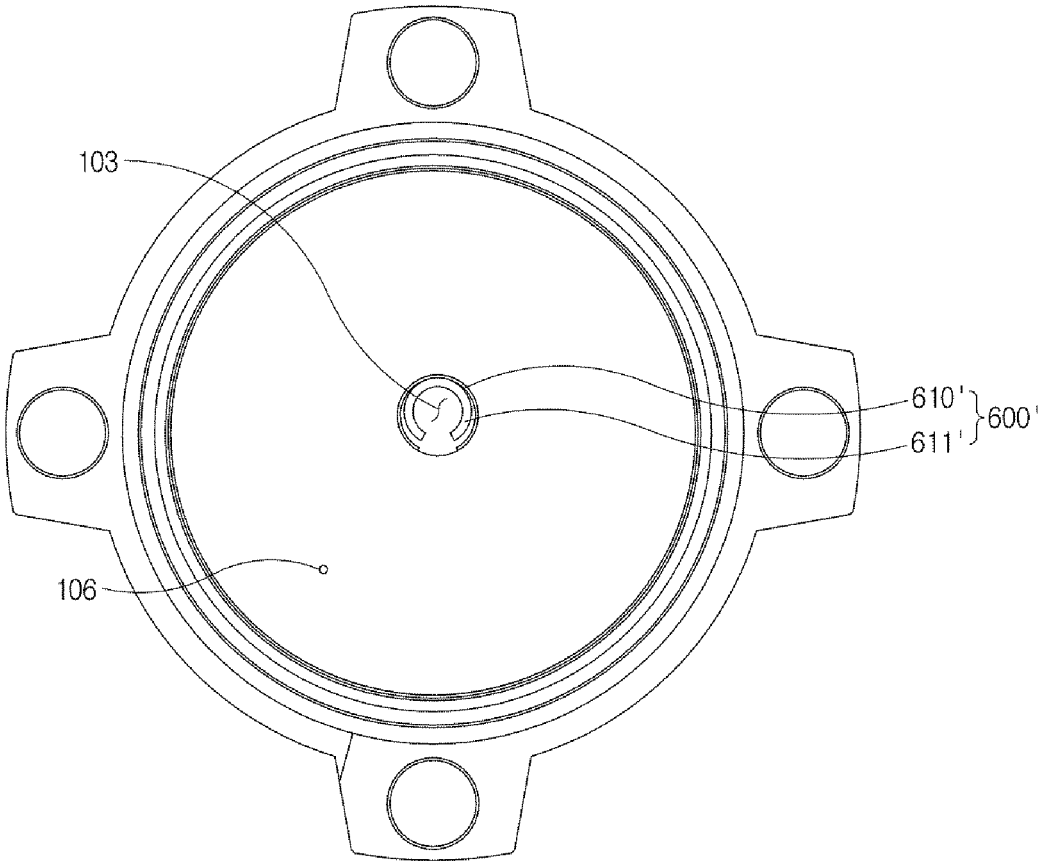
FIG. 32 is a rear view illustrating a fixed scroll of a compressor according to an embodiment of the present disclosure.

FIG. 30 is a side cross-sectional view illustrating some constituent elements of a compressor according to an embodiment of the present disclosure. FIG. 31 is a side cross-sectional view illustrating some constituent elements of a compressor according to an embodiment of the present disclosure. FIG. 32 is a rear view illustrating a fixed scroll of a compressor according to an embodiment of the present disclosure.

The bypass port 105' may be provided at one side of the discharge passage 107' instead of the uppermost surface 102*a* of the fixed scroll 100. In order to guarantee performance of the compressor 1 or the capacity of the middle-pressure chamber 400 as necessary, the space in which the bypass port 105 or the bypass valve 130 is formed may be replaced with the space of the middle-pressure chamber 400.

In this case, the bypass valves (600, 600') may be disposed at the inside of the fixed scroll 100, and the bypass port 105' may be disposed at one side of the discharge passage 107', such that the space of the middle-pressure chamber 400 is guaranteed.

That is, whereas the bypass passage 108 according to the above-mentioned embodiment is formed in an up-and-down direction from the upper side of the compression chamber 60 to the upper end of the fixed scroll 100, the bypass passage 108' of FIG. 30 includes a bended part 108*a* arranged at the flow passage, such that the bypass passage 108' may be arranged in a vertical direction instead of the up-and-down direction.

Therefore, in the discharge passage 107', refrigerant discharged after completion of refrigerant compression within the compression chamber 60 may be mixed with other refrigerant discharged from the bypass port 105' through the bypass passage 108'.

The mixed refrigerant may be discharged through the discharge port 103, may pass through the discharge guide 200, and may finally flow into the discharge cover 80.

The bypass valve 600 may be provided at a bended part 108*a* of the bypass passage 108'.

The bypass valve 600 may include a valve portion 610 configured to open or close one end of the bypass passage 108', an elastic member 620 configured to allow the valve portion 610 to perform vertical elastic motion, and a support portion 630 configured to support the elastic member 620.

Prior to operation of the compressor 1, the valve portion 610 may be located in a downward direction by the elastic member 620, such that the compression chamber 60 may be severed from the bypass passage 108'.

Thereafter, if the compressor 1 operates, refrigerant flows into the compression chamber 60, and the valve portion 610 is pressed upward by refrigerant pressure, such that the bypass passage 108' may communicate with the compression chamber 60.

The valve portion 610 moves to the upper side of the bended part 108*a*, and refrigerant flows into the bypass port 105' after passing through the bended portion 108*a*, such that the resultant refrigerant may be discharged to the discharge passage 107'.

When the compressor 1 stops operation, the valve portion 610 may be pressed downward by the elastic member 620, and may be located in a manner that the compression chamber 60 is separated from the bypass passage 108'.

Referring to FIGS. 31 and 32, the bypass valve 600' may be provided in the discharge passage 107'.

In more detail, the bypass valve 600' may be located at the position corresponding to the bypass port 106' to open or close the bypass port 105' disposed at the discharge passage 107'.

The bypass valve 600' may be formed in a ring shape, one side of which is opened. The bypass valve 600' may include a valve body 610' to open or close the bypass port 105' disposed on the discharge passage 107', and a stopper 611' to limit movement of the valve body 610'.

The valve body 610' may be formed in a ring shape, one side of which may be opened and the other side may be fixed by a rivet or the like. The bypass port 105' may be disposed between one side and the other side of the valve body 105' to open or close the bypass port 105'.

One or more bypass ports 105' may be disposed between one side and the other side of the valve body 610'. When refrigerant is discharged, the refrigerant is discharged to the discharge passage 107' through the bypass port 105'. In this case, because refrigerant is pressed, the bypass valve 610' may move in the refrigerant-pressed direction (i.e., toward the center point of the discharge passage 107') by discharge pressure, such that the bypass port 105' may be opened.

A stopper 611' having a predetermined size corresponding to the valve body 610' may be provided at the inner circumference of the valve body 610'. The other side of the stopper 611' may include a portion to be riveted in the same manner as in the valve body 610, and the stopper 611' may be formed to gradually move upward in a direction from one side to the other side thereof.

As is apparent from the above description, the compressor according to the embodiments guarantees the space in which the bypass valve can be installed by a discharge guide mounted to a discharge portion of the fixed scroll, and at the same time forms the middle pressure portion, resulting in efficiency improvement of the compressor.

The compressor according to the embodiments reduces noise and vibration generated from the discharge portion of the fixed scroll by the discharge guide.

Although a few embodiments of the present disclosure have been shown and described, it would be appreciated by those skilled in the art that changes may be made in these embodiments without departing from the principles and spirit of the present disclosure, the scope of which is defined in the claims and their equivalents.

What is claimed is:

1. A compressor comprising:

a main body;

a fixed scroll fixable to an interior space of the main body, and including a flat uppermost surface;

an orbiting scroll configured to perform an orbiting motion relative to the fixed scroll;

a compression chamber, formed by the fixed scroll and the orbiting scroll, to compress a refrigerant and including a discharge passage to discharge the compressed refrigerant and a bypass passage to discharge the refrigerant being compressed in the compression chamber from the compression chamber;

a discharge valve and a bypass valve provided at the uppermost surface of the fixed scroll, wherein the discharge valve is configured to open or close the discharge passage and the bypass valve is configured to open or close the bypass passage;

a discharge guide provided on the fixed scroll to cover the discharge valve, the bypass valve, and the uppermost surface of the fixed scroll;

a back-pressure cover provided over the discharge guide; and a middle-pressure chamber formed by the fixed scroll, the back-pressure cover, and the discharge guide, wherein a portion of the discharge guide is openable to discharge the refrigerant through the discharge guide in the compression chamber into the middle-pressure chamber, and wherein when middle-pressure refrigerant is introduced into the middle-pressure chamber, the back-pressure cover is configured to slide upward towards a top of the main body by a middle-pressure of the middle-pressure chamber.

2. A compressor comprising:

a main body;

a fixed scroll fixable to an interior space of the main body, and including a flat uppermost surface;

an orbiting scroll configured to perform an orbiting motion relative to the fixed scroll;

a compression chamber, formed by the fixed scroll and the orbiting scroll, to compress a refrigerant and including a discharge passage to discharge the compressed refrigerant and a bypass passage to discharge the refrigerant being compressed in the compression chamber from the compression chamber;

a discharge valve and a bypass valve provided at the uppermost surface of the fixed scroll, wherein the discharge valve is configured to open or close the discharge passage and the bypass valve is configured to open or close the bypass passage;

a discharge guide provided on the fixed scroll to cover the discharge valve, the bypass valve, and the uppermost surface of the fixed scroll;

a back-pressure cover provided over the discharge guide; and a middle-pressure chamber formed by the fixed scroll, the back-pressure cover, and the discharge guide, wherein when middle-pressure refrigerant is introduced into the middle-pressure chamber, the back-pressure cover is configured to slide upward towards a top of the main body by a middle-pressure of the middle-pressure chamber, and a high-pressure higher than the middle-pressure of the middle-pressure chamber is formed inside the discharge guide by the sliding of the back-pressure cover.

3. The compressor according to claim 2, wherein:

the discharge passage is configured to communicate with an upper part of the fixed scroll at a center part of the compression chamber to discharge the compressed refrigerant to an outside of the compression chamber; and one end of the bypass passage communicates with an upper part of the compression chamber, and the other end of the bypass passage is bent at one end of the bypass passage and thus communicates with one side of the discharge passage.

4. The compressor according to claim 3, wherein the bypass valve is provided on the bypass passage and is located at a bent part of the bypass passage to open or close the bypass passage.

5. The compressor according to claim 3, wherein the bypass valve is located at an inner surface of the discharge passage to open or close the other end of the bypass passage.

6. A compressor comprising:

a main body including a high-pressure chamber and a low-pressure chamber;

a discharge cover fixable to an interior space of the main body to divide the interior space of the main body into a suction space and a discharge space;

a fixed scroll;

an orbiting scroll;

a compression chamber formed by the fixed scroll and the orbiting scroll to compress a refrigerant;

a discharge port formed in the fixed scroll to discharge the compressed refrigerant to an outside of the compression chamber;

a bypass port formed in the fixed scroll to discharge the refrigerant being compressed in the compression chamber to the outside of the compression chamber;

a discharge guide provided on the fixed scroll to guide the refrigerant discharged from the discharge port and the bypass port to the discharge cover;

a back-pressure cover provided over the discharge guide; and a middle-pressure chamber formed by the fixed scroll, the back-pressure cover, and the discharge guide, wherein when middle-pressure refrigerant is introduced into the middle-pressure chamber, the back-pressure cover is configured to slide upward toward the discharge cover and come into contact with the discharge cover by a middle-pressure of the middle-pressure chamber.

7. The compressor according to claim 6, wherein the discharge guide includes:

a first cover portion configured to cover an uppermost surface of the fixed scroll;

a second cover portion configured to cover the bypass port and the discharge port, and formed to protrude upward from the first cover portion;

a guide portion opened upward from the second cover portion.

8. The compressor according to claim 7, further comprising:

a discharge valve configured to open or close the discharge port; and a bypass valve configured to open or close the bypass port, wherein the second cover portion covers the discharge valve and the bypass valve.

9. The compressor according to claim 7, wherein the second cover portion includes a rounding portion.

10. The compressor according to claim 7, further comprising:

a middle-pressure chamber discharge port to discharge the refrigerant from the compression chamber into the middle-pressure chamber, wherein the discharge guide includes a pass-through portion by which the refrigerant discharged from the middle-pressure chamber discharge port passes through the discharge guide and flows into the middle-pressure chamber.

11. The compressor according to claim 10, wherein the pass-through portion is formed as an opening in one side of the first cover portion.

12. The compressor according to claim 7, wherein the back-pressure cover is configured to perform reciprocating motion in a vertical direction relative to the discharge cover by a pressure of the refrigerant flowing into the middle-pressure chamber.

13. The compressor according to claim 7, wherein the back-pressure cover includes:

an opening portion disposed between the guide portion and the discharge cover; and a first ring-shaped wall provided to communicate the discharge guide to the discharge cover during an ascending motion of the back-pressure cover.

14. The compressor according to claim 7, wherein the back-pressure cover includes an inner circumference formed to extend from an upper part of the discharge guide to one side of the fixed scroll to cover the discharge guide and the uppermost surface of the fixed scroll.

15. The compressor according to claim 14, wherein the inner circumference of the back-pressure cover includes a ring-shaped wall formed to extend from a lower part of the uppermost surface of the fixed scroll to one side of the fixed scroll, and wherein the fixed scroll includes a back-pressure cover guide which corresponds to a second ring-shaped wall and guides a vertical reciprocating motion of the back-pressure cover.

16. The compressor according to claim 6, wherein the fixed scroll includes a ring-shaped middle-pressure wall formed to extend upward along an outer wall of an uppermost surface of the fixed scroll.

17. The compressor according to claim 16, wherein the discharge guide is provided in an interior space formed by the ring-shaped middle-pressure wall.

18. The compressor according to claim 16, wherein:

the back-pressure cover includes an outer circumference contacting an inner circumference of the ring-shaped middle-pressure wall; and the outer circumference of the back-pressure cover is guided to the inner circumference of the ring-shaped middle-pressure wall and performs vertical motion.

19. The compressor according to claim 16, wherein the middle-pressure chamber is formed by an inner circumference of the ring-shaped middle-pressure wall, an inner surface of the back-pressure cover, and an outer surface of the discharge guide.

20. The compressor according to claim 16, wherein the middle-pressure chamber is formed by an inner circumference of the ring-shaped middle-pressure wall, an inner surface of the back-pressure cover, an outer surface of the discharge guide, and one side of the uppermost surface of the fixed scroll.

* * * * *